US005579616A

United States Patent [19]

Farag

[11] Patent Number: 5,579,616

[45] Date of Patent: Dec. 3, 1996

[54] PANEL-SECURING SYSTEM

[76] Inventor: F. Aziz Farag, 43 N. Juliet St., Iselin, N.J. 08830

[21] Appl. No.: 319,025

[22] Filed: Oct. 6, 1994

Related U.S. Application Data

[63] Continuation-in-part of Ser. No. 936,048, Aug. 26, 1992, Pat. No. 5,355,645.

[51] Int. Cl.[6] ..... E04B 2/88

[52] U.S. Cl. ..... 52/235; 52/204.5; 52/311.1; 52/730.5

[58] Field of Search ..... 52/235, 787.1, 52/786.1, 786.11, 786.13, 730.3, 730.4, 730.5, 730.6, 311.1, 204.5, 204.53, 204.54, 204.58, 204.59, 204.62, 656.5, 656.6

[56] References Cited

U.S. PATENT DOCUMENTS

| | | | |
|---|---|---|---|
| 3,112,534 | 12/1963 | Winnan . | |
| 3,553,918 | 1/1971 | Dauson | 52/235 X |
| 3,734,550 | 5/1973 | Vance . | |
| 3,797,171 | 3/1974 | Sukolics | 52/235 X |
| 3,974,608 | 8/1976 | Grearson | 52/235 |
| 4,021,987 | 5/1977 | Schnebel et al. . | |
| 4,207,717 | 6/1980 | Hubbard . | |
| 4,387,542 | 6/1983 | Wehr | 52/235 X |
| 4,552,790 | 11/1985 | Francis . | |
| 4,608,793 | 9/1986 | Yost et al. | 52/235 |
| 4,621,478 | 11/1986 | Phillips et al. | 52/235 X |
| 4,633,631 | 1/1987 | Crandell . | |
| 4,650,702 | 3/1987 | Whitmyer . | |
| 4,672,784 | 6/1987 | Pohlar | 52/235 |
| 4,686,805 | 8/1987 | Forslin . | |
| 4,704,839 | 11/1987 | Kay . | |
| 4,724,637 | 2/1988 | Evans . | |
| 4,738,065 | 4/1988 | Crandell . | |
| 4,756,132 | 7/1988 | Newman et al. | 52/235 |
| 4,799,344 | 1/1989 | Francis . | |
| 4,803,817 | 2/1989 | White et al. . | |
| 4,809,475 | 3/1989 | Emmer . | |
| 4,815,245 | 3/1989 | Gartner . | |
| 4,817,351 | 4/1989 | Micholovic . | |
| 4,837,996 | 6/1989 | Eckelt . | |
| 4,841,700 | 6/1989 | Matthews . | |
| 4,905,435 | 3/1990 | Horst . | |
| 4,912,898 | 4/1990 | Holmes . | |
| 5,014,477 | 5/1991 | MacDonald . | |
| 5,018,326 | 5/1991 | Reynolds | 52/235 |
| 5,094,051 | 3/1992 | Miller . | |
| 5,199,236 | 4/1993 | Allen . | |
| 5,235,790 | 8/1993 | Ishikawa et al. | 52/235 |
| 5,263,292 | 11/1993 | Holland et al. | 52/235 |

FOREIGN PATENT DOCUMENTS

| | | | |
|---|---|---|---|
| 236618 | 11/1964 | Austria | 52/204.5 |
| 2387575 | 11/1978 | France | 52/730.5 |
| 2621643 | 4/1989 | France | 52/204.53 |
| 2714378 | 9/1978 | Germany | 52/730.3 |

*Primary Examiner*—Carl D. Friedman
*Assistant Examiner*—Laura Saladino
*Attorney, Agent, or Firm*—Oliff & Berridge

[57] ABSTRACT

A panel-securing system for securing a panel in a desired position includes a mullion portion having a channel formed therein and a holding element received within the channel of the mullion portion and coupled with a panel fastener attached to the panel to secure the panel to the mullion portion, the holding element including a snap-locking element. The mullion preferably extends in a longitudinal direction toward the panel, and the channel preferably is angled with respect to the longitudinal direction. The holding element preferably is inserted into the channel to urge the panel fastener toward the mullion portion to secure the panel to the mullion portion. Further, a plurality of mullion extensions of different lengths can be used to create a curtainwall of irregular three-dimensional geometry.

25 Claims, 28 Drawing Sheets

PANEL-SECURING SYSTEM

CROSS REFERENCE TO RELATED APPLICATIONS

This application is a Continuation-In-Part of U.S. patent application Ser. No. 07/936,048, filed Aug. 26, 1992, now U.S. Pat. No. 5,355,645. The subject matter of this application also is related to the subject matter of U.S. patent application Ser. No. 08/170,971, now U.S. Pat. No. 5,381, 637, the disclosure of which is incorporated herein by reference.

BACKGROUND OF THE INVENTION

1. Field of the Invention

The invention relates to an apparatus and method for forming multiple shapes of curtainwall in general, and in particular, stopless butt-joint curtainwalls having thermal breaks therein.

2. Description of Related Art

Modern buildings often have continuous exterior facing panel areas extending around the building exterior. These panel areas can include panels of glass, metal, plastic, granite and the like of single, multiple or composite construction. The panels can be supported by either direct or indirect attachment. In indirect attachment, a building's supporting structural framework is used to support non-bearing walls. These non-bearing exterior walls with metal gridded substructure are referred to as curtainwalls. The problem of easily and permanently installing curtainwalls or replacing glass, facing panels or infills without: 1) exterior stops at the four sides of glass and other facing panels; 2) a thick front width of members known as the "sight line", which may show beyond the stopless glass; 3) glass secured with structural silicone sealant adhesion; 4) the use of an exterior scaffold for exterior application or access to joints; 5) the use of extra metal and elements for providing extruded covers for inside the member central structural element; 6) extensive field labor; 7) wet caulking weather seal field application; 8) high cost of custom engineered adapters and retainers for installing different facing panels, infill or framed operable windows, with different thickness, or located in a different face plane; 9) the chance for air and water infiltration through extra joints because of the use of additional adapters and retainers; 10) high cost when different curtainwall systems are used in different locations of the same building for changing appearance or depth of curtainwall mullions; and 11) the possibility of failure of an integrated structural thermal break when subjected to tension stress, has persisted in the curtainwall community, and these considerations are among the advantages of the present invention.

One conventional solution for providing a stopless glazing curtainwall is to provide a structural sealant between glass panels and metal members of supporting frame. U.S. Pat. No. 4,552,790 describes an approach for providing a unit that can be glazed without exterior stops or caps using structural sealant. Glass plates are joined with a spacer to seal the edges of the insulated glass panels. Structural sealant is used on two opposite sides of the spacer to bind the spacer to an adjacent inside surface of the glass plate. Application of the structural sealant is performed from the exterior of the building.

U.S. Pat. No. 4,724,637 describes an approach for interior installation of panels with a system for two sided vertical butt glaze. In this system, a factory glazed and assembled frame is insertable between head and sill liners from the building interior. The head and sill liners are visible from the exterior of the building. The glass panels are bonded to a portion of the frame by structural silicone. The use of structural silicone has the disadvantage of being a relatively expensive material. Further, the application of structural silicone to glass panels requires extensive labor, quality assurance and testing. Also, it is not clear how the glass panels would be replaced.

U.S. Pat. No. 4,912,898 describes an approach for providing a curtainwall having a smooth outer surface which is rail free. A curtainwall which is rail free requires butt joints having sufficient strength to hold the panels in place. This patent describes a butt joint which combines both an adhesive with a bracket to securely hold the panels in place. In this system access from outside the building is needed to install the panels.

U.S. Pat. No. 4,841,700 describes a narrow flush glazed framing system for curtainwalls including thermal breaks. A pair of vertical mullions define the outer boundaries of the framing system. Dual panels of glass are supported between the vertical mullions. A vertical intermediate mullion has a deep glazing channel and a slot for forming a shallow glazing channel. A thermal break is positioned in the deep glazing channel and a thermal break filler assembly fits into the slot to form the shallow glazing channel. The thermal break filler assembly includes a thermal break filler element snap fit between a pair of filler halves to form a three piece filler assembly. The thermal break filler assembly makes it possible to reduce the visible mullion face dimension without reducing the depth of the glazing channels of the mullion.

SUMMARY OF THE INVENTION

Briefly described, this present invention comprises a curtainwall multi-system with dry gasket installation. The curtainwall system can include forming an irregular geometric impression to the observer by the combination of various four sided stopless butt-joint glass or facing panels of metal, granite, marble, or insulation. Facing panels can be single, multiple or composite panels in one or multiple face planes. These panels are mechanically secured and supported by means of hook retainer clip assembly.

Field labor for initial installation or replacement of glass or facing panels takes place completely from inside the building. This installation comprises mechanically securing the hook clip retainer assembly to a preassembled grid. The grid includes vertical mullions. Vertical mullions can be split interlocking mullion halves which are anchored to the building's structure. Premolded thermal break and a primary integrated structural thermal break can be part of the grid and together with the tension relieving clip provides a fail safe thermal break system.

Preferably, the hook retainer clip assembly includes a hook clip and a bracket retainer which are snapped together. A pair of guide flanges can be used to guide the bracket retainer into engagement with the hook clip. Various shaped hook retainer clip assemblies provide the ability for installing framed operable windows, louvers, sandwiched thick insulation panels, infill panels of varying widths, or the like. Dual glazed of glass, laminated glass, tempered glass or acrylic sheets or any combination thereof can also be used with the hook retainer clip assembly.

BRIEF DESCRIPTION OF THE DRAWINGS

Preferred embodiments are described with reference to the drawings, in which like reference numerals denote like elements throughout the Figures, and in which.

DETAILED DESCRIPTION OF PREFERRED EMBODIMENTS

Figure 1:
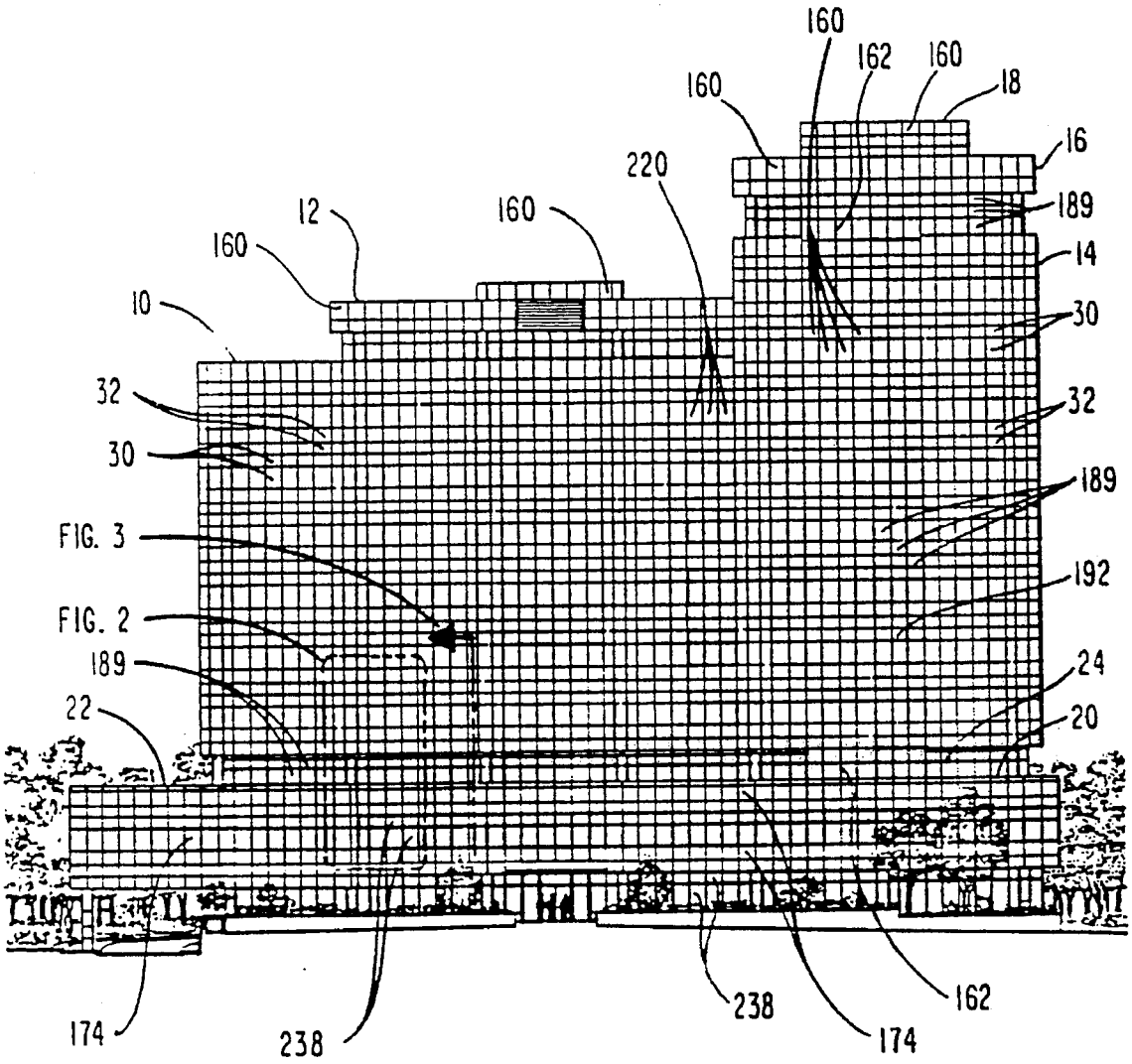
FIG. 1 is a front elevational view of a building facade of the first embodiment of the invention.

FIG. 1 is a front elevational view of a building facade according to embodiments of the invention. Multiple blocks form the exterior of the building. In this embodiment, the building includes an upper angle shaped building with two perpendicularly connected wing blocks. Preferably, each wing block has a different height. Upper left wing block 10 has typical floors and a recessed top floor 12. Upper right wing block 14 has typical floors and a recessed top floor 16. A utility room 18 is positioned above recessed top floor 16. Wing blocks 10 and 14 are located on top of a lower base block 20. A recessed floor 24 is positioned between lower base block 20 and wing blocks 10 and 14. Base block 20 includes a projected left portion 22.

Each floor of upper blocks 10 and 14 preferably has two tiers of insulated glass panels 30 installed side by side. The horizontal blocked vision strip at each floor slab and beam is two tiers of single spandrel glass 32. The two tiers of spandrel glass 32 are installed side by side for blocking the vision area between floors. An enclosure strip 162 can also be exposed to the observer. Preferably, the different blocks are formed of different facade materials for creating different graphic impressions.

Figure 2:
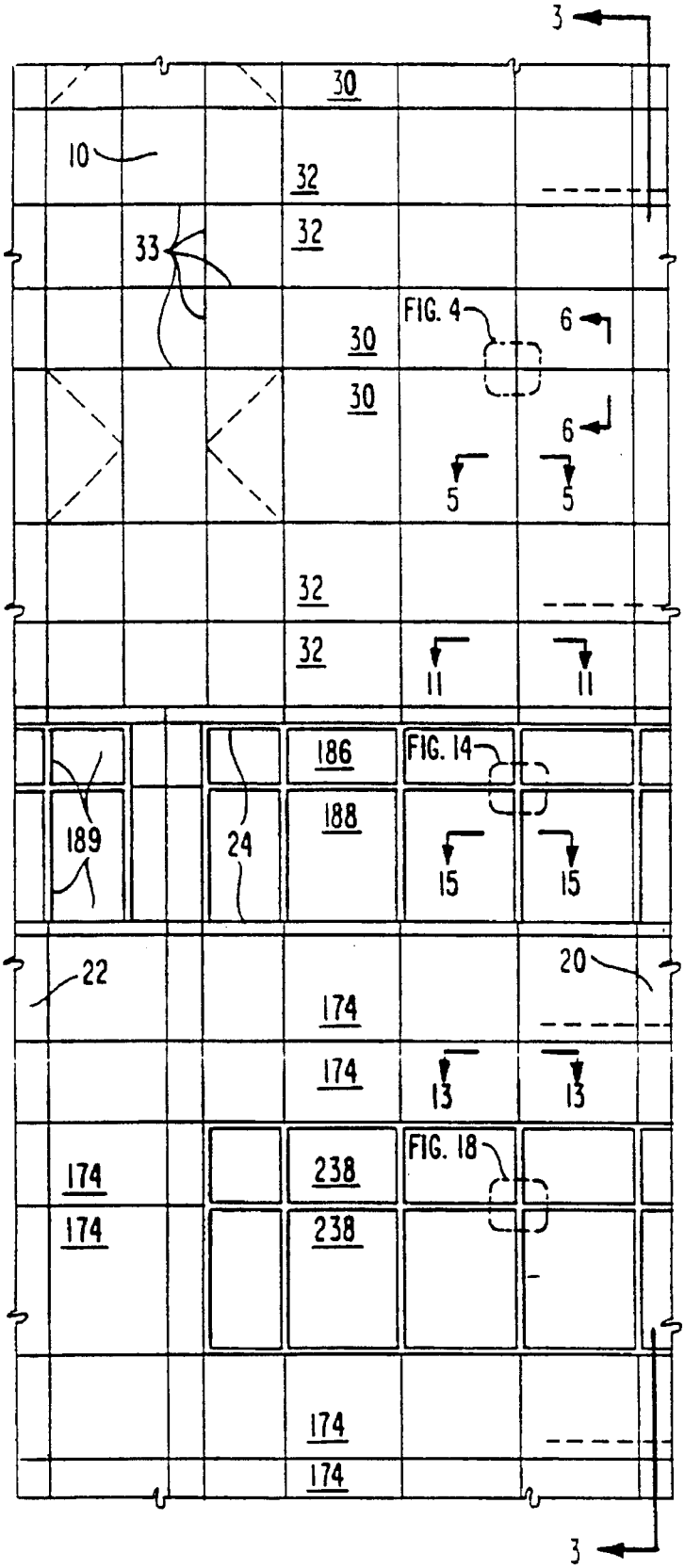
FIG. 2 is a front elevational view of an enlarged central part of the first embodiment of the invention.

FIG. 2 is a portion of FIG. 1 showing the locations of different facade materials. Facade materials can include insulated glass panels 30, single spandrel glass 32, back attached panels 160, edge attached panels 174, dual glazing 238 and exposed members curtainwall 189 or non-exposed members stopless curtainwall. It will be appreciated to those skilled in the art that numerous other facade materials and arrangements of the materials can be used.

Figure 3:
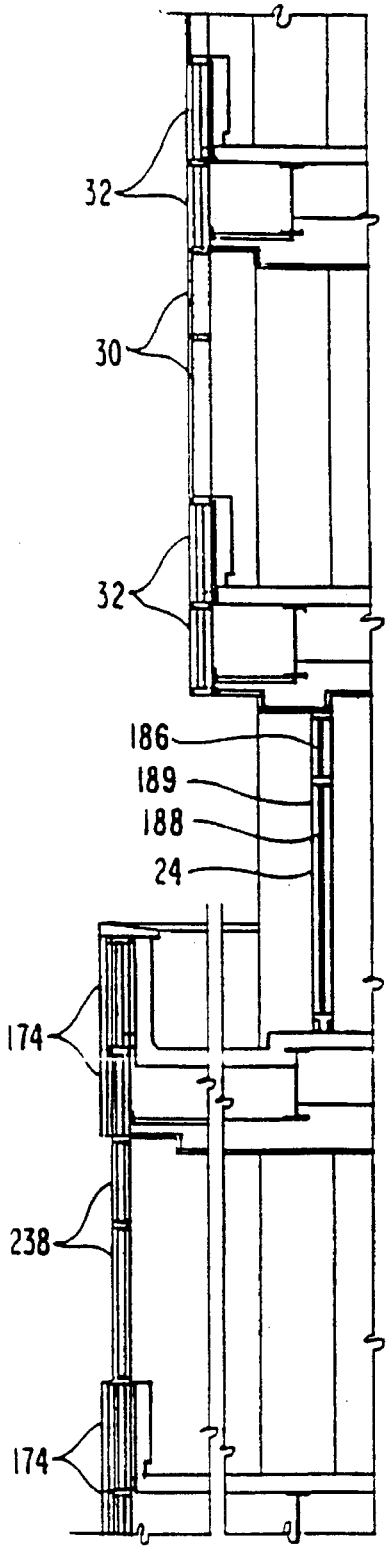
FIG. 3 is a vertical cross-sectional view of the central part of the first embodiment of the invention shown in FIG. 2.

FIG. 3 is a vertical cross-sectional view at the enlarged central area of the front elevational view FIG. 2. Insulated glass panel 186 and spandrel glass panel 188 are recessed from single spandrel glass 32 and insulated glass panels 30.

Figure 4:
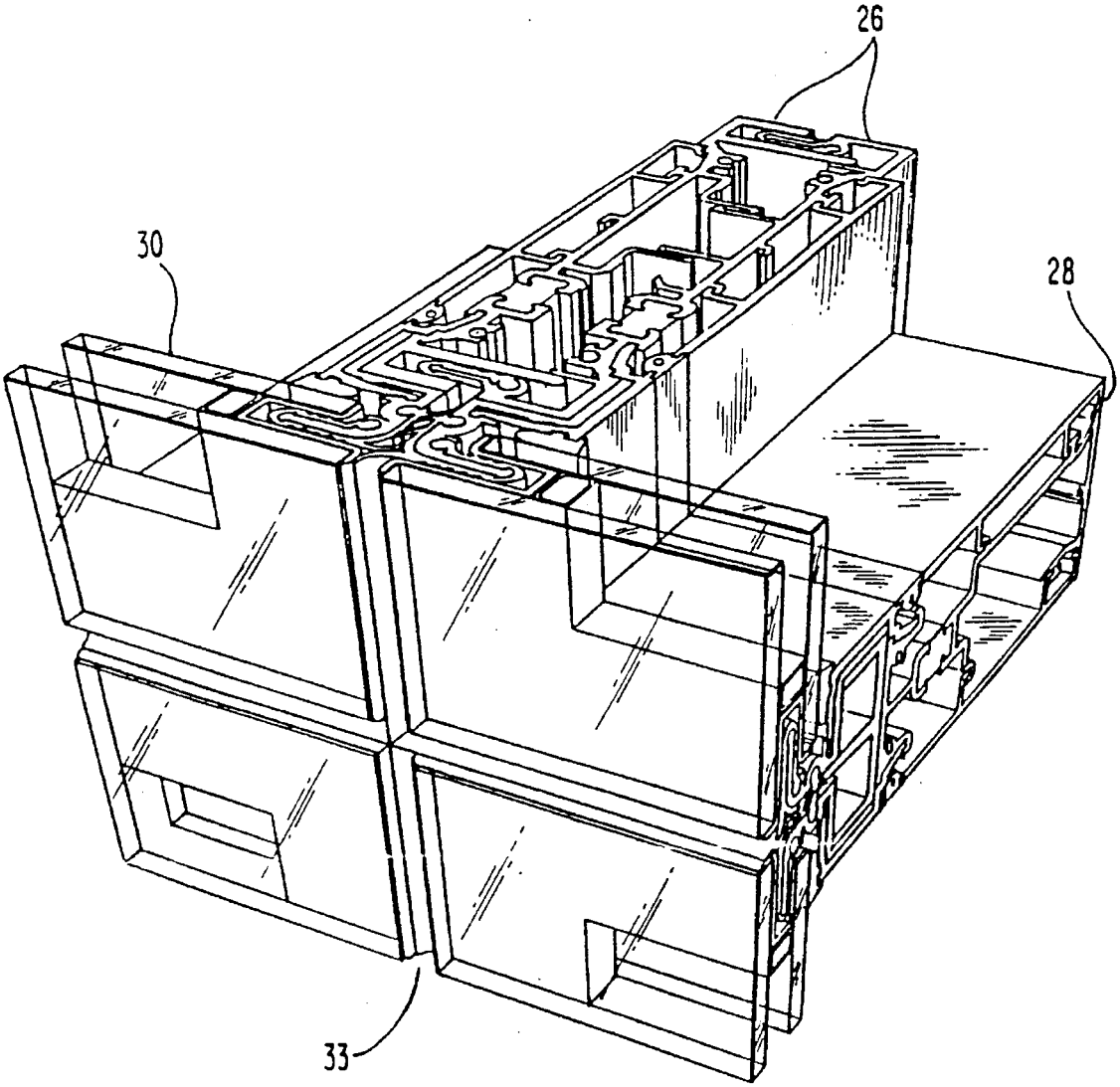
FIG. 4 is a perspective cross-sectional view of a four sided, stopless, butt-joint insulated glass curtainwall according to first embodiment of the present invention.

FIG. 4 illustrates a perspective sectional view at an intersection of a vertical mullion 26 and a horizontal mullion 28. In this first embodiment, the facing panel is insulated glass 30. The graphic impression presented to an observer of the building is of an all glass monolithic facade with four sided stopless butt-joints 33. Insulated glass panels 30 are preferably separated by joint 33, which is a space of between about 0.3 and 0.5 of an inch. Typically, this first embodiment of the curtainwall system is applied in floors of upper blocks 10 and 14.

Figure 5:
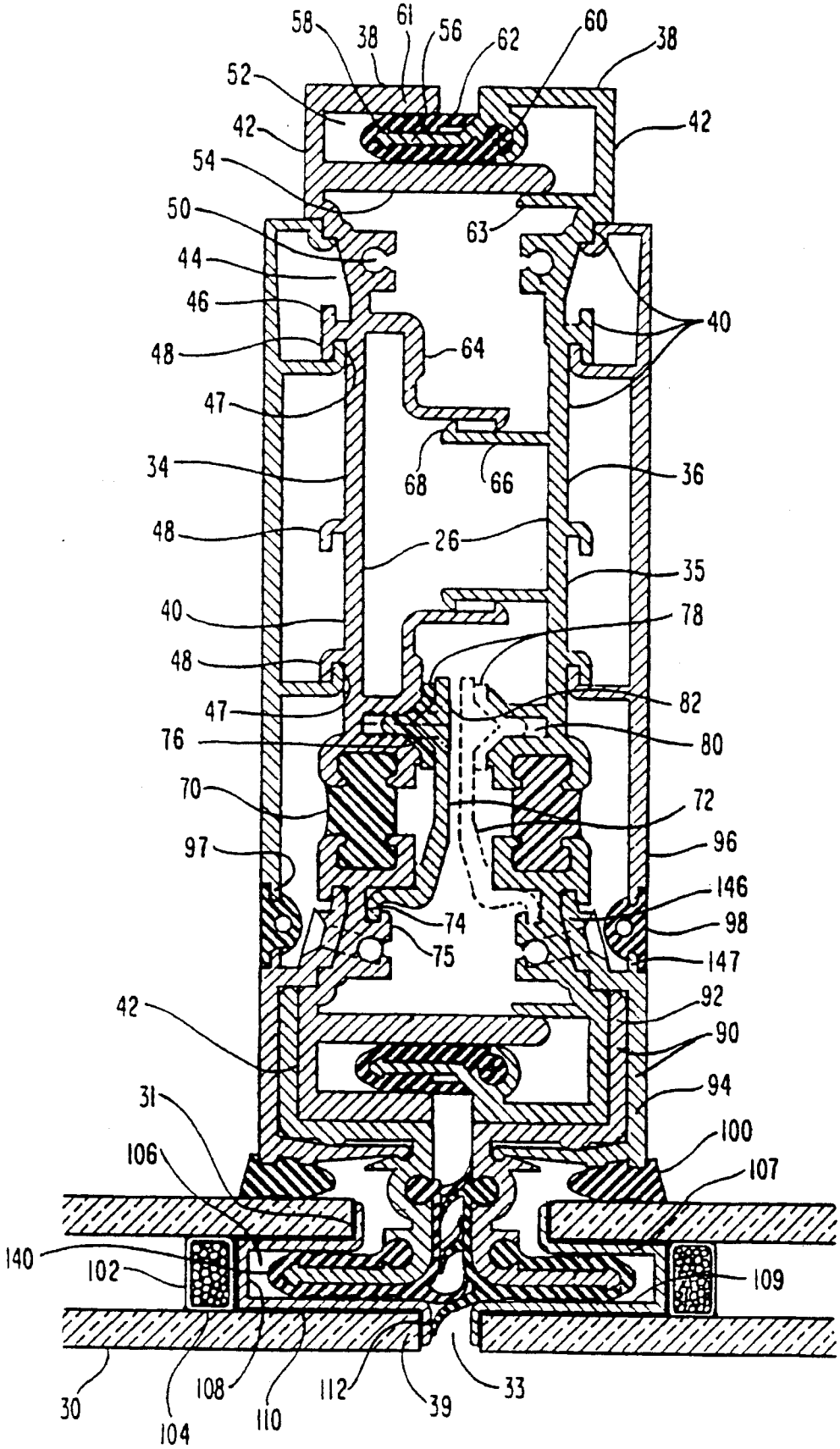
FIG. 5 is a horizontal cross-sectional view of a vertical mullion and retainer clip assembly of the first embodiment of the present invention.

FIG. 5 illustrates a horizontal cross-sectional view through vertical mullion 26. Vertical mullion 26 is a split mullion. Vertical mullion 26 includes interlocking female half 34 and male half 36. Female half 34 is channel shaped with an end flange 38 at each end. Portions of male half 36 are shaped symmetrically to female half 34. However, the interlocking ends and central portion are complementary to each other.

A channel web 35 forms a side of vertical mullion 26 in both the female half 34 and male half 36. Channel web 35 is divided into a middle strip 40 and two side strips 42 in the same plane. Alternatively, middle strip 40 can be in a different plane than side strips 42. Chamber 44 is formed adjacent each end of middle strip 40. Chamber 44 has a sloped back and barb 46. Chamber 44 receives and restrains matching shoe shaped ends 146 of bracket retainer 94. Hook barb 48 protrudes from middle strip 40 for engagement with cover hook barb 47 of cover 96. A screw cavity 50 is positioned at the back of each chamber 44 for attachment to horizontal mullions.

An interlocking cavity 52 is formed between end flange 38 and female flange 54 at each end of female half 34. End flange 38 of male half 36 has a protruding male flange 56. Male flange 56 has a protruding arrow head 58 at one end thereof. Gasket pocket 60 is formed at the base of male flange 56. A wrap around weather gasket 62 is fitted around male flange 56 and interlocks with gasket pocket 60.

Preferably, weather gasket 62 has fluted curved reveals 61 for providing a capillary break and for providing ease of installation of the assembly. A guide flange 63 extends from male half 36 to retain female flange 54 in contact with weather gasket 62. Flanges 64 have a "Z" shape and extend from female half 34 for snapping into locking engagement with flanges 66 which extend from male half 36. Flanges 64 and 66 have barbed ends 68 for securing and interlocking the female half 34 with the male half 36.

A thermal break 70 is applied to each mullion half at the middle strip 40 adjacent to the outer side of chamber 44. The size and composition of material for forming the thermal break 70 can vary as known in the art. Thermal break 70 is subjected only to compression stress. Tension stress on thermal break 70 is relieved with relieving clip 72. Relieving clip 72 can be formed of a plurality of about 1.25 inch long clips. Preferably, a minimum of two clips are applied to each mullion half at the same location. In the alternative, the clips can be positioned in staggered locations.

Preferably, relieving clip 72 is used to attach side strip 42 to middle strip 40. Clip 72 preferably has a "Z" shape. Outer side short flange 74 of clip 72 is retained by barb 75 to side strip 42. An inner side long flange 76 is fastened to the inner rear portion of middle strip 40. Flange 76 includes a pointed triangle shape projection to engage with a "Y" shaped premolded thermal break 78 which engages screw reveal 80. Fastener screw 82 penetrates through clip 72 and premolded thermal break 78 for threaded engagement with the side walls of screw reveal 80.

Retainer clip assembly 90 mechanically engages the edge of insulated glass panels 30. Retainer clip assembly 90 secures insulated glass panels 30 to an adjacent male mullion half 36 or female mullion half 34. Preferably, retainer clip assembly 90 is formed of two pieces. Retainer clip assembly 90 includes hook clip 92, which has a substantially C-shaped outer portion as shown in FIGS. 5 and 7–10, and bracket retainer 94. Cover 96 is attached to middle strip 40 with hook barbs 97 and retained by a round-back gasket 98. Wedge gasket 100 is installed between clip retainer assembly 90 and insulated glass panel 30.

Insulated glass panel 30 is preferably formed with a shorter inner glass sheet end 31 than outer sheet end 39. A conventional desiccant spacer strip 102 and primary seal adhesive 104 is used between insulated glass panels 30 for spacing the panels apart, holding them together, and providing weather seals. A deep channel shaped cavity 106 is formed behind spacer strip 102. Glass panels 30 form the sides of the channel shaped cavity 106. An optional lining for cavity 106 is preferably applied including a channel 108 with inner flange 107 shorter than outer flange 109. Inner flange 107 and outer flange 109 have an angled lip 112 which engages glass panels 30. Channel 108 is a structural enhancement for protecting primary seal adhesive 104 against delamination caused by the constant tension stress applied by wrap-around weather gasket 140. Gasket 140 applies constant pressure on the two sides of cavity 106, which spreads apart glass panels 30 and can cause delamination. Angled lip 112 protects against chipping and breaking of the glass panels 30, while providing improved adhesion and seal between the panels. A secondary seal 110 is applied between channel 108 and glass panels 30.

Figure 6:
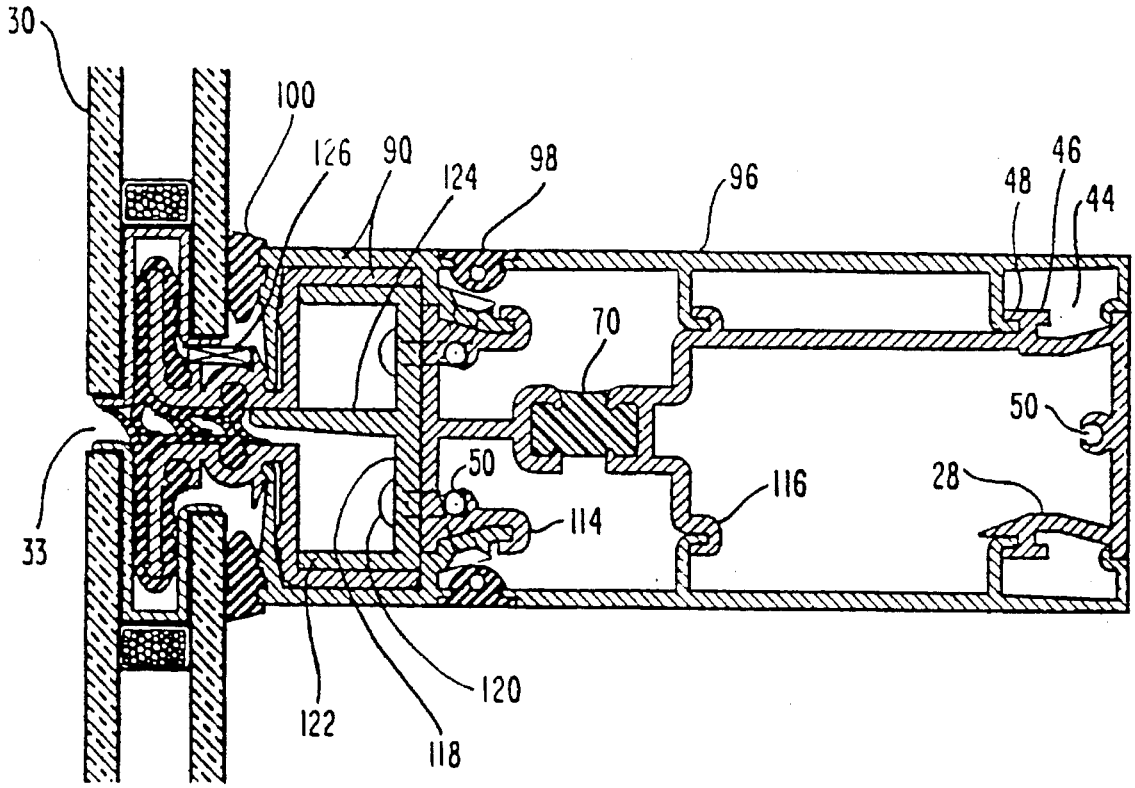
FIG. 6 is a vertical cross-sectional view of a horizontal mullion and retainer clip assembly of the first embodiment of the present invention.

FIG. 6 is a vertical cross-sectional view of horizontal mullion 28. Horizontal mullion 28 is as deep as the middle strip 40 of vertical mullion 26 as shown in FIG. 5. Thermal break 70 connects a "T" shaped front portion 114 to a channel shaped rear portion 116. Chambers 44 with barbs 46 are symmetrically formed at the corners of horizontal mullion 28. Chambers 44 with barbs 46, hook barbs 48 and screw cavities 50 in the horizontal mullion 28 are aligned with similar elements formed in the middle strip 40 of vertical mullion 26.

Horizontal mullion 28 is a cross-member attached to vertical mullion 26 as shown in FIG. 4. Horizontal mullion 28 transmits stress to vertical mullion 26. In a preferred embodiment, horizontal mullion 28 spans about 4 feet and vertical mullion 26 has a vertical span of about 10 feet between connections. The reduced size of horizontal mullion 28 allows the mullion to have a smaller depth aligned with the middle strip 40 at the sides of vertical mullion 26. This reduced size of the horizontal mullion 28 provides reduced costs of materials.

Extension piece 118 is "W" shaped. Extension piece 118 is fastened with screws 120 to the front of horizontal mullion 28. Extension piece 118 has end flanges 122 and central flange shelf 124. Central flange shelf 124 extends horizontally for supporting the gravity load of insulated glass panels 30. Preferably, the bottom edge of panel 30 is supported by setting blocks 126. In the alternative, the bottom edge of panel 30 can be a continuous gasket.

Insulated glass panel 30 is installed to horizontal mullion 28 with retainer clip assembly 90, cover 96, round-back gasket 98 and wedge gasket 100, as described above with respect to the vertical mullion 26.

Figure 7:
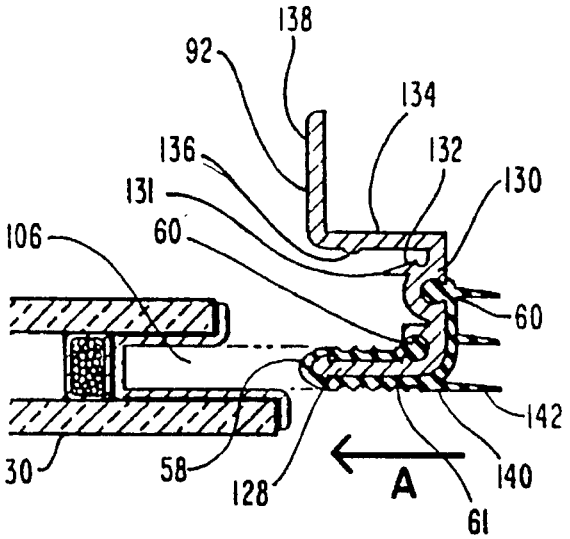
FIG. 7 is a horizontal cross-sectional view of a grooved edge of an insulated glass panel showing installation of a hook clip.

Installation procedures for installing the glass panels are shown in FIG. 7 through 10. FIG. 7 shows first installation step "A" for installing outer side flange 128 of the hook clip 92 into channel shaped cavity 106. Preferably, hook clip 92 has a sickle shape. Outer side flange 128 is positioned parallel to and faces glass panel 30. Arrow head 58 is formed at one end of outer side flange 128. Gasket pockets 60 are formed on either side of web 130. A guide flange 131 has side barb 132 projecting toward the inside of hook clip 92. Guide flange 131 guides into place and interlocks with bracket retainer 94.

Rear side segment 134 of hook clip 92 is arranged parallel to panel 30. A pointed projection 136 transmits the outward load from hook clip 92 to bracket retainer 94 when the panel is subjected to suction or wind load. Segment 138 of hook clip 92 is arranged perpendicular to panel 30. Segment 138 has the same depth as side strips 42 of vertical mullion 26.

A wrap-around weather gasket 140 is installed around and interlocks with outer side flange 128 and gasket pockets 60. Weather gasket 140 has fluted curved reveals 61 for providing a capillary break. Flexible flange flaps 142 project parallel to panel 30 and extend into joint 33 between adjacent panels 30 to form weather seals for joint 33, as shown in FIGS. 4, 5 and 6.

Figure 8:
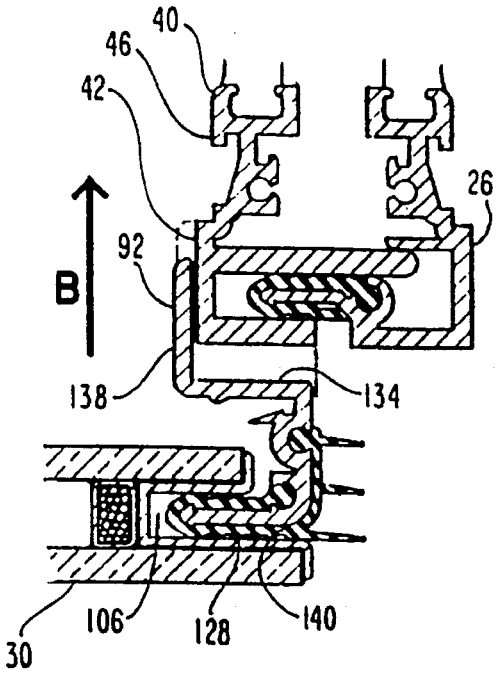
FIG. 8 is a horizontal cross-sectional view of the exterior front portion of the vertical mullion showing installation of the insulated glass panel.

FIG. 8 illustrates movement of panel 30 toward vertical mullion 26 after hook clip 92 is applied, shown as step "B". Panel 30 is urged inward until rear side 134 of hook clip 92 rests against vertical mullion 26. Segment 138 can be adjusted by known manufacturing methods to rest tightly against side strip 42 of vertical mullion 26.

Figure 9:
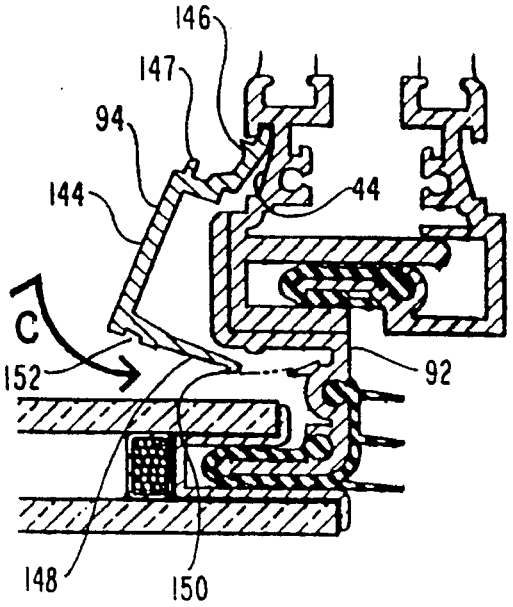
FIG. 9 is a horizontal cross-sectional view of the exterior front portion of the vertical mullion showing installation of a bracket retainer.

As shown in step "C" of FIG. 9, bracket retainer 94 is installed by engaging the tip of shoe end 146 of central web 144 into chamber 44. Barb 147 is formed at inner end of web 144. Outer end of web 144 has a flange 148. Flange 148 has a tapered shape and ends with side barb 150. Reveal 152 is formed to retain wedge gasket 100. In addition, an optional reveal for accommodating screw heads can be formed in the shoe end 146.

Shoe end 146 is restrained by chamber recess 44 with barb 46. Barb 46 anchors bracket retainer 94 against mullion 26 and permits circular movement of bracket retainer 94 to circularly move during installation. The circular movement gradually positions bracket retainer 94 tightly against hook clip 92. Flange 148 of bracket retainer 94 with side barb 150 is guided into contact with hook clips 92 to snap-lock in with side barb 132 of guide flange 131. Thus, side barb 150, flange 148 and guide flange 131 of hook clip 92 act as locking elements. After installation, bracket retainer 94 and hook clip 92 are interlocked and this assembly is restrained to the mullion.

In the case of extreme wind suction, the outward load applied on hook clip 92 by panel 30 is transmitted to bracket retainer 94 at the pointed projection 136 of rear side 134. It is known that load stress causes material strain and any load transmitted to the flange 148 could cause material strain and an outward flexing of the flange 148. The transmission of stress to bracket retainer 94 provides for tighter interlocking between the clip and bracket assembly and control of the deformation of flange 148.

Figure 10:
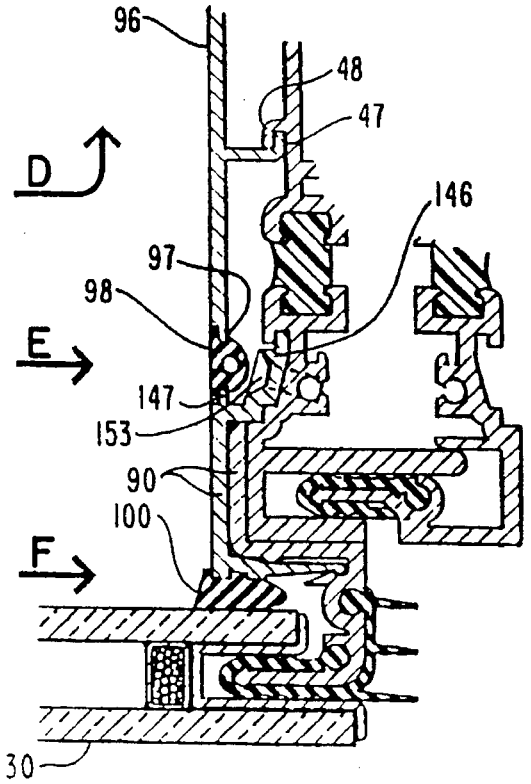
FIG. 10 is a horizontal cross-sectional view of the exterior front portion of the vertical mullion showing the installation of a side cover, optional screws, round back gasket and wedge gasket.

FIG. 10 shows optional screw fasteners 153 installed through an aperture in shoe end 146 for fastening shoe end 146 within a recess of the mullion. Preferably, cover 96 is installed in step "D"0 by retracting it backward so that cover hook barbs 47 engage with hook barbs 48 of the mullion. Cover 96 is held in place by installing a round back gasket 98, as shown in step "E". The use of round back gasket 98 prevents thermal bridging. Gasket 98 has grooved sides for engaging barb 147 of bracket retainer 94 and hook barb 97 of cover 96.

Wedge gasket member 100 is installed in step "F". Wedge gasket 100 is inserted into the space between flange 148 and the inside face of insulated glass panel 30. Wedge gasket 100 has a protrusion for engaging reveal 152 of flange 148.

Figure 11:
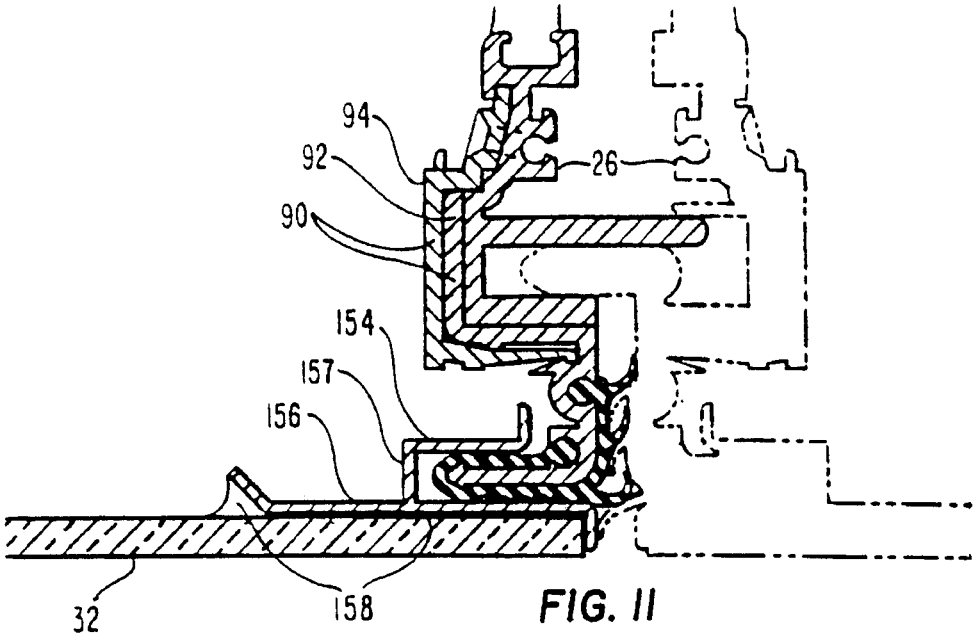
FIG. 11 is a horizontal cross-sectional view of the second embodiment of the present invention with a vertical mullion and an attached single spandrel glass panel.

FIG. 11 is a horizontal cross-sectional view of the exterior front portion of half a vertical mullion 26 and retainer clip assembly 90 in a second embodiment of the present invention. In this embodiment, a single spandrel glass panel 32 is installed with similar installation procedures as shown in FIG. 7 through FIG. 10.

An outer flange 156 is positioned at the end of shaped channel edge 154. Outer flange 156 is extended at the back of spandrel glass panel 32 to form a "T" shape with web 157 of channel 154. A primary seal 158 adheres and weather seals spandrel glass panel 32. In the case of extreme wind suction, the "T" shape prevents the corner of the channel, where web 157 meets outer flange 156, from peeling away from spandrel glass panel 32 since the load is transmitted to bracket retainer 94. Channel edge 154 is similar to channel 108.

Figure 12:
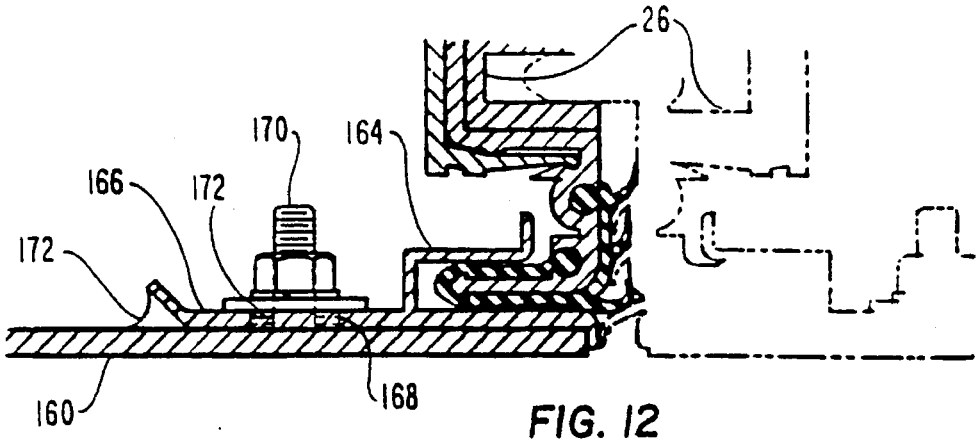
FIG. 12 is a horizontal cross-sectional view of the third embodiment of the present invention with a vertical mullion and a back attached facing panel.

FIG. 12 is a horizontal cross-sectional view of the exterior front portion of half a vertical mullion 26 and retainer clip assembly 90 in a third embodiment. Back attached panel 160 is installed with similar installation steps shown in FIG. 7 through FIG. 10.

Preferably, back attached panel 160 can be applied at an elevator shaft vertical enclosure strip 162 which is part of upper right wing block 14. In this embodiment, enclosure strip 162 is positioned above the roof of lower base block 20 and extends to the roof of utility rooms 18. Back attached panel 160 can also be applied at a parapet wall and spandrel area at the roof of top floors 12 and 16 and at the utility room 18.

Back-attached facing panel 160 is preferably a thick gauge aluminum sheet of about 0.125 to 0.188 inch thick. Channel edge 164 has an extended flange 166. Preferably flange 166 has oversized holes 168 for receiving aluminum welded studs 170. Back-attached facing panel 160 is weather sealed with caulking 172 between the back-attached facing panel 160 and edge 164. Channel edge 164 is similar to channel edge 108 and 154.

Figure 13:
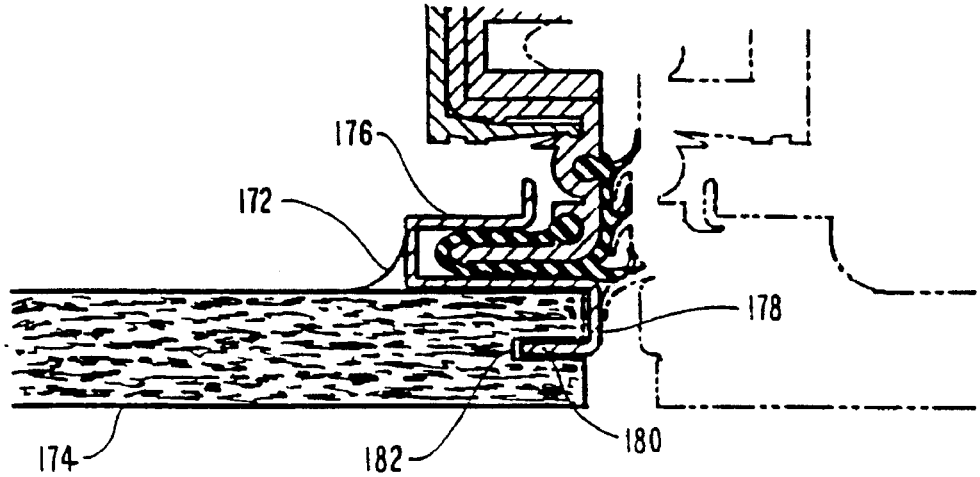
FIG. 13 is a horizontal cross-sectional view of the fourth embodiment of the present invention with a vertical mullion with an edge attached facing panel.

FIG. 13 is a horizontal cross-sectional view of a fourth embodiment of the present invention with an edge-attached facing panel 174. Edge-attached facing panel 174 is preferably used in the lower base block 20 and its projected left portion 22 of the curtainwall system. Edge-attached facing panel 174 is preferably a granite panel about 0.75 inch thick. Edge flange 176 has an outer angled lip to form an edge cap 178. An engaging flange 180 engages with a matching groove 182 formed in the granite panel edge.

Preferably engaging flange 180 and groove 182 are formed continuously as shown. In the alternative, engaging flange 180 can be formed in a plurality of small length pieces of at least two pieces per side or as studs integrated with the extended panel edge cap 178 for engaging drilled holes at an edge of granite panel. Edge-attached facing panel 174 is weather sealed with caulking 172.

The engagement of the panel in a channel shaped space engagement allows for thermal expansion and manufacturing tolerances. The channel shaped space can be coordinated with the panel manufacturer so as to be an integral part of panel construction. In the alternative, the channel shaped space can be attached as a separate formed edge. Channel shaped space can be made of extruded or bent metal having a one piece or multiple piece construction. The exact shape of channel shaped space and formed edge can be determined by the method of attachment. This attachment method is determined from the factors of panel thickness, weight, area, material, applicable production tooling and the panel construction. In the alternative, the panels can be made of insulated tempered glass, laminated glass, single spandrel glass, glass, metal, plastic, acrylic, granite, marble, natural or man made materials. The panels can be single, multiple or composite construction including a foam core and thermal insulation panels.

Figure 14:
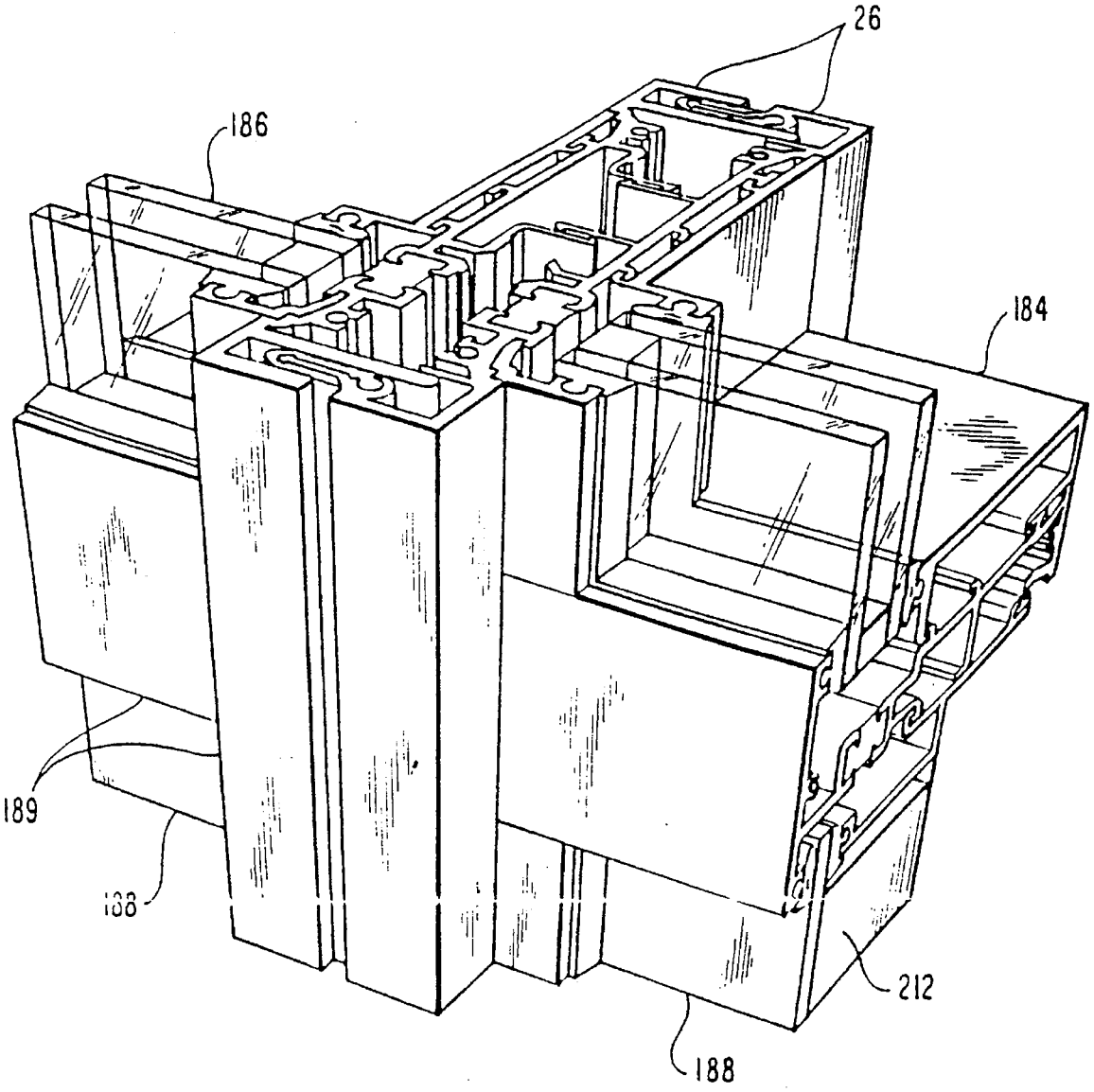
FIG. 14 is a perspective cross-sectional view of the fifth embodiment of the present invention with an exposed curtainwall grid members having insulated glass panels and single spandrel glass panels with a back attached thermal insulation board.

FIG. 14 is a perspective partial cross-sectional view of an intersection of vertical mullion 26 and central horizontal mullion 184 of a fifth embodiment of the present invention. Panel 186 is formed of insulated glass and panel 188 is formed of spandrel glass with back-attached thermal insulation board 212. The graphic impression to the observer is that of an exposed members curtainwall 189. The face of vertical mullion 26 is projected more than horizontal mullion 184. Horizontal mullion 184 is preferably formed to be the same width as the middle strip 40. Horizontal mullion 184 is similar to previously described horizontal mullion 28.

Preferably, an exposed members curtainwall system 189 is applied at: recessed floor 24 between lower base block 20 and wing blocks 10 and 14; at recessed top floors 12 and 16; and at the vertical recessed strip 192 of upper block 14. Recessed strip 192 connects floor 24 with top floor 16.

Figure 15:
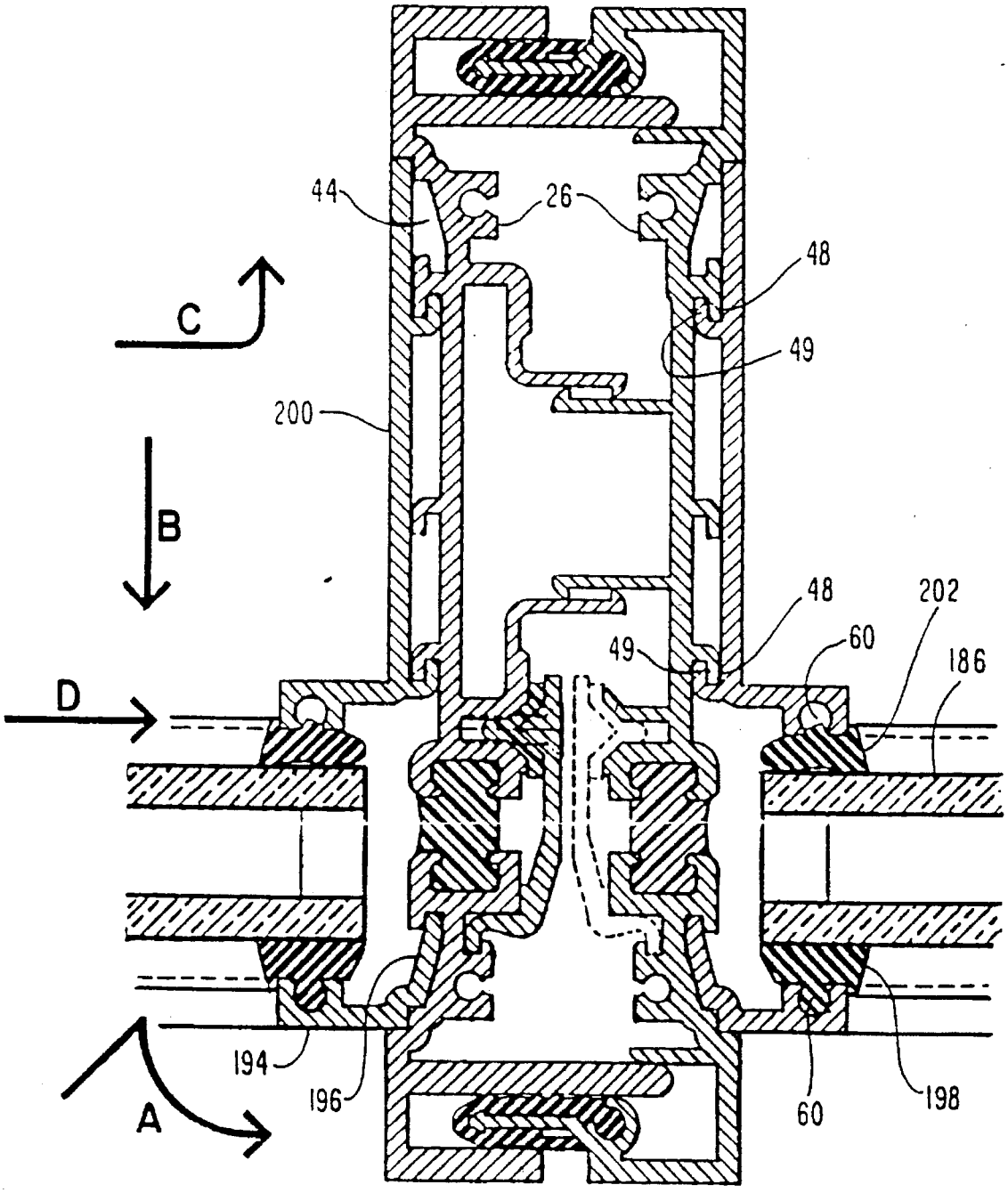
FIG. 15 is a horizontal cross-sectional view of the vertical mullion of the fifth embodiment of the present invention shown in FIG. 14.

FIG. 15 illustrates a horizontal cross-sectional view through vertical mullion 26 of exposed members curtainwall 189 shown in FIG. 14. In step "A", outer side retainer 194 is installed. Outer side retainer 194 is angle shaped, and is restrained in chamber 44 with shoe shaped side 196. Outer side retainer 194 has a glazing gasket 198 installed in gasket pocket 60. Insulated glass panel 186 is installed, in step "B", from the inside of the building by moving the panel in an outward direction until it rests against glazing gasket 198. Bracket retainer 200 is angle shaped and is installed, in step "C", by hooking it in place with a retracting movement. inward barbs 49 engage with matching barbs 48 of the mullion. Wedge gasket 202 is installed in step "D" by inserting it into the space between retainer 200 and the inner face of insulated glass panel 186. Wedge gasket 202 has a protrusion for engaging the gasket pocket 60 of retainer 200.

Figure 16:
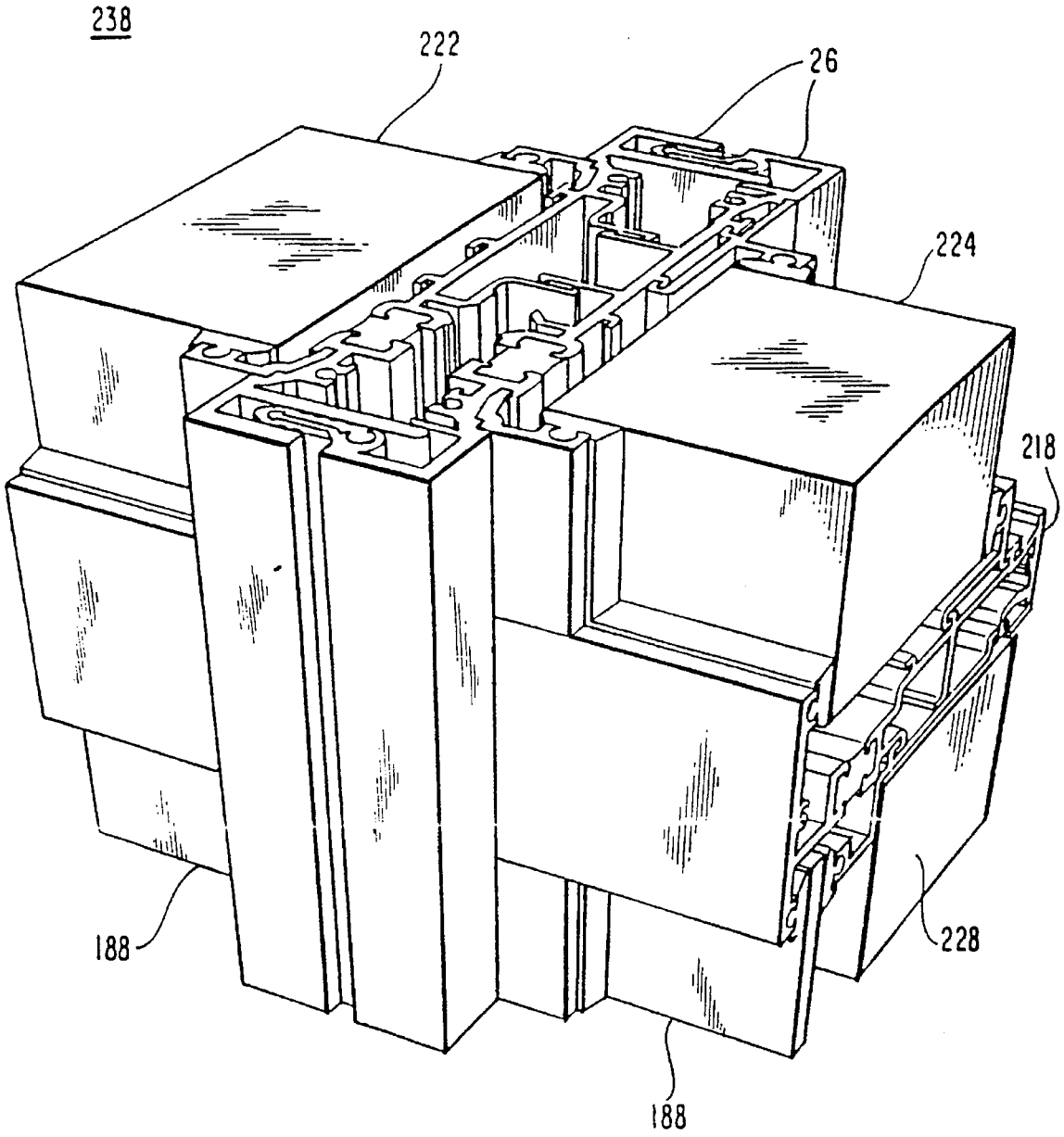
FIG. 16 is a perspective cross-sectional view of a sixth embodiment of the present invention having a curtainwall system with different thickness of infill panels and single spandrel glass panels with thermal insulation board in an alternative location.

FIG. 16 is a perspective cross-sectional view showing an intersection of a vertical mullion 26 and the central horizontal mullion 218 in a sixth embodiment of the present invention. This embodiment is used in units 220 shown in FIG. 1. Unit 220 is preferably three panels wide and two tiers high. The facing panel adaptions in this embodiment are of different thickness infills 222 and 224 and spandrel glass panel 188. A rigid thermal insulation board 228 is installed in the alternative location, behind spandrel glass panel 188 and with a space cavity in between insulation board 228 and spandrel glass panel 188. This exposed members curtainwall 189 is similar to FIG. 14, but with different thickness infills. Bracket retainers similar to bracket retainers 94, 194 and 200 can be used to attach infills 222 and 224, and spandrel glass 188 with insulation board 228.

Figure 17:
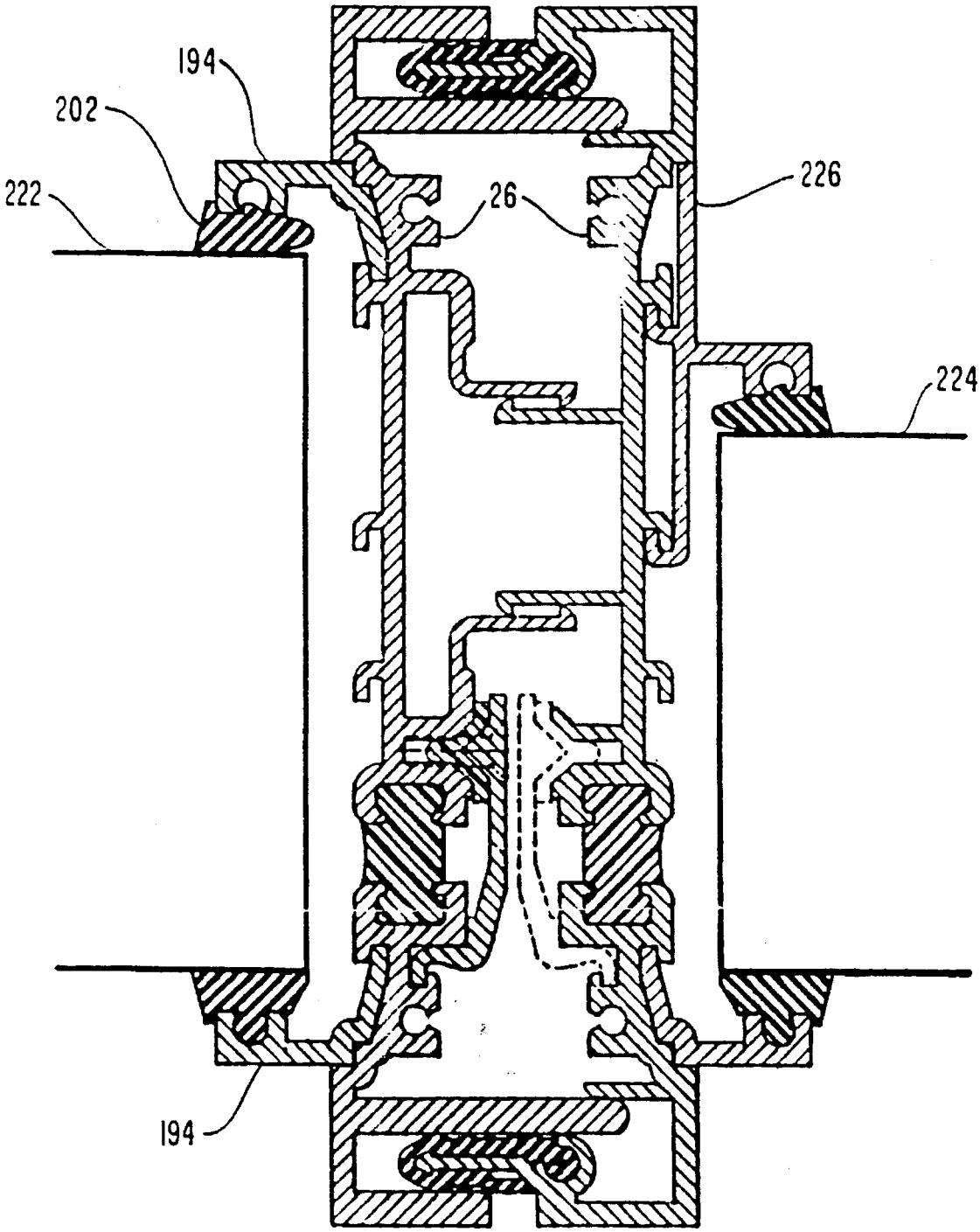
FIG. 17 is a horizontal cross-sectional view of the vertical mullion of the sixth embodiment of the present invention as shown in FIG. 16.

FIG. 17 illustrates a horizontal cross-sectional view through vertical mullion 26 shown in FIG. 16. Infill 222 is a framed operable window. Infill 224 is a framed louver grill. Infill 222 is preferably with a deeper frame than infill 224. Retainer clip assembly 194 and 226 are installed with steps similar to the steps shown in FIG. 15. Wedge gasket 202 is inserted between retainer clip assembly 194 and 226 and panels 222 and 224.

Figure 18:
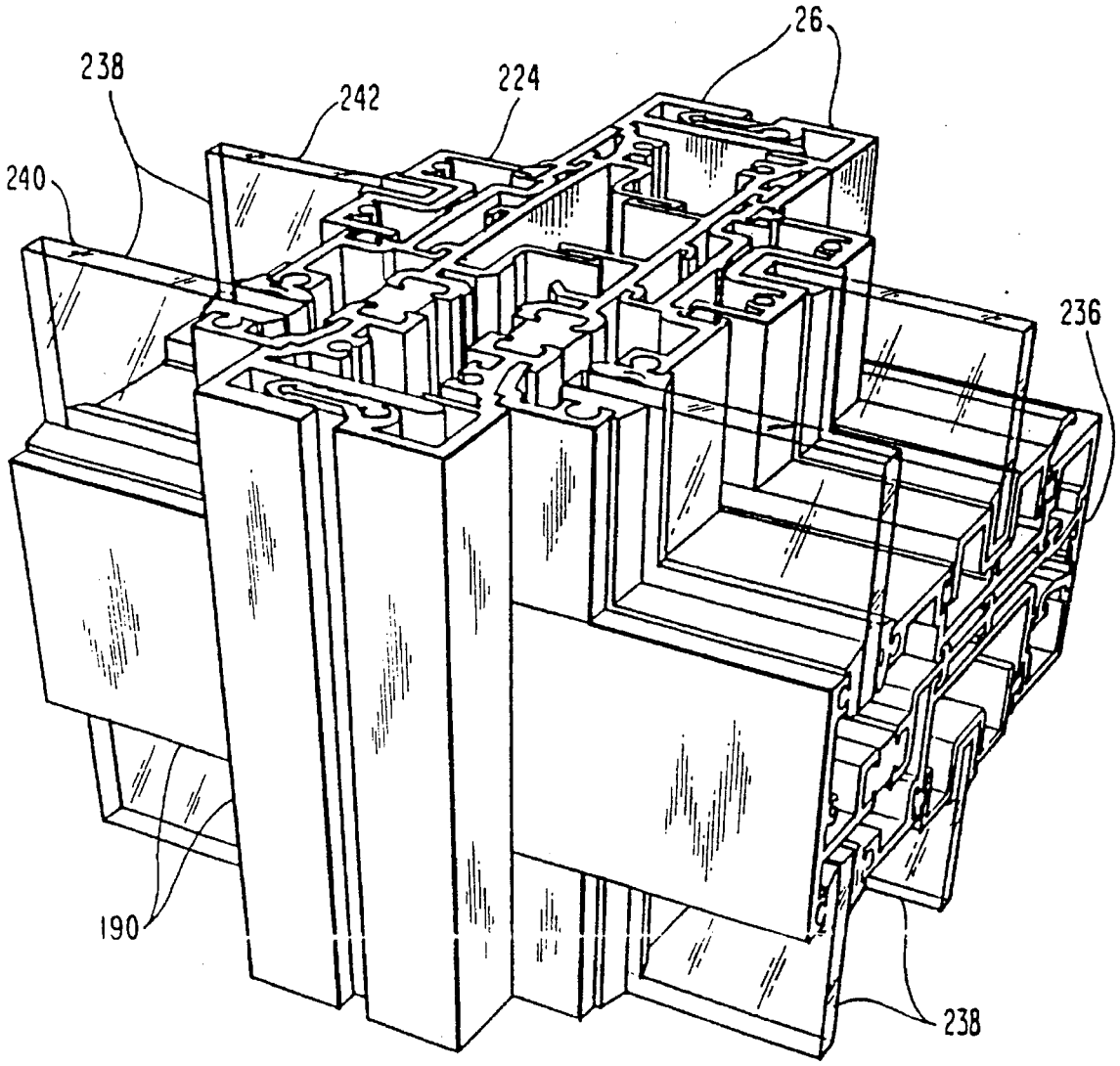
FIG. 18 is a perspective cross-sectional view of a seventh embodiment of the present invention having a curtainwall system with dual glazing.

FIG. 18 illustrates a pictorial perspective sectional view of a seventh embodiment showing an intersection of a vertical mullion 26 and a horizontal mullion 236. Facing panel adaptation in this embodiment is dual glazing 238. This exposed members curtainwall 190 is similar to FIG. 14 and FIG. 16.

Dual glazing 238 is preferably applied at the vision area of the first floor and at the second floor in the horizontal central strip of lower base block 20. Dual glazing 238 is composed of an outer side clear acrylic sheet 240 and an inner side laminated glass sheet 242 which is independently framed in a demountable frame 244. Horizontal and vertical mullions which are similar to respective mullions 26 and 28 can be shaped to receive the dual glazing.

Figure 19:
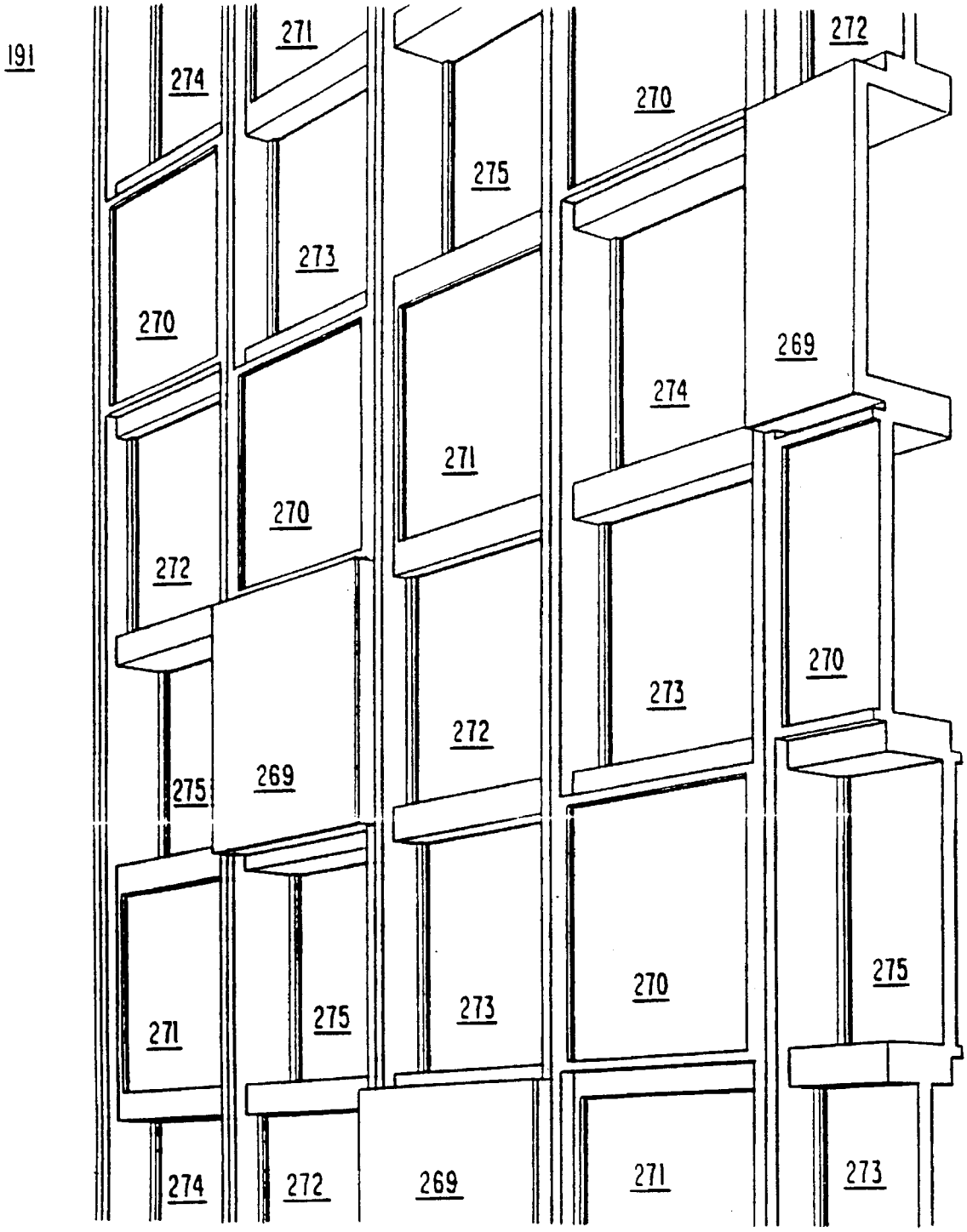
FIG. 19 is a perspective cross-sectional view of an eighth embodiment of the present invention having a curtainwall system with an irregular geometric impression of different facing panels and different face planes.

FIG. 19 illustrates an eighth embodiment of the present invention of a perspective sectional view showing exposed curtainwall 191, which is similar to FIGS. 14, 16 and 18. Insulated glass panels are used in seven different face planes to provide an irregular geometric impression for curtainwall 191. Preferably, curtainwall 191 is used in an open atrium in a building.

Outer face plane 269 is an insulated glass panel 30. Insulated glass panel 30 is installed as shown in FIG. 7 through FIG. 10.

Typically vertical mullion 26 and horizontal mullion 28 form the grid members for supporting the glass panels 30 as shown in FIG. 4 through FIG. 10. Retainer clip assembly 90 is modified to receive each of the different shaped inside and outside glazing retainers for each face plane. Vertical mullion 26 and horizontal mullion 28 receive retainer clip assembly 90 for each face plane. Retainer clip assembly 90 is installed at the four sides of each panel.

Outer face plane 269 is preferably positioned about 1.5 inches in front of vertical mullion 26 and overlaps about half of the mullions at the four sides of panel 30. Face panels of face planes 270, 271, 272, 273, 274 and 275 are preferably conventional insulated glass panels having an average of about one inch spacing between each of the face planes. Glazing and installation of retainers, covers and gaskets is similar to FIG. 15.

The irregular impression created by the different face planes will be enhanced by the daylight shades and sun cast shadows. The reflective face of the glass panels creates a different mirror image for exposed mullion side wall at the different recessed face planes. In the alternative, glass, facing 22 panel or infills of different materials can be used. The impression is formed in at least two face planes and in any graphic or geometric arrangement.

Figure 20:
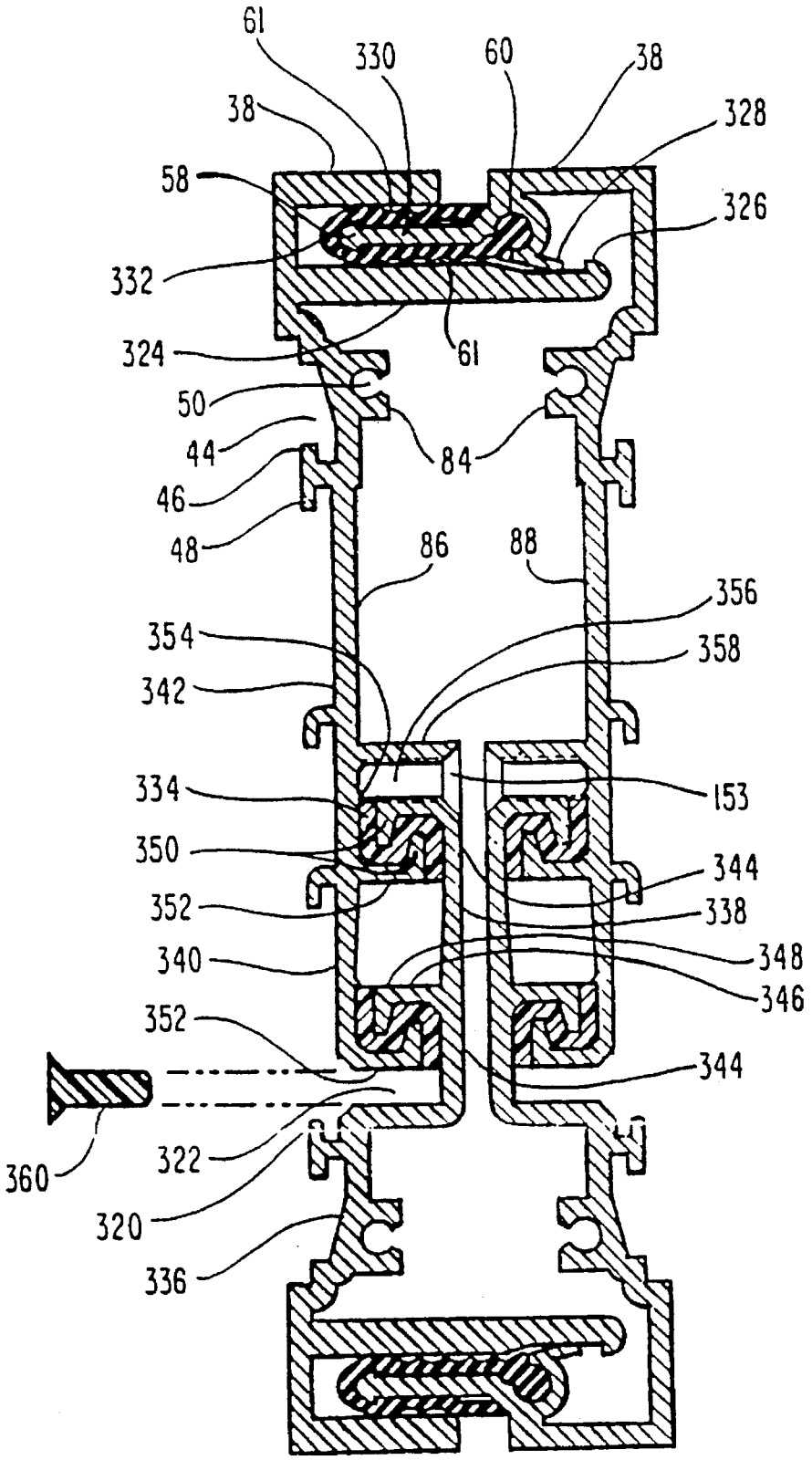
FIG. 20 is a horizontal cross-sectional view of an alternative vertical mullion including an alternative form of thermal break.

FIG. 20 illustrates a horizontal cross-sectional view through vertical mullion 84. Vertical mullion 84 is an alternative for vertical mullion 26. Vertical mullion 84 has interlocking female half 86 and male half 88 which are symmetrically shaped except for the end portions, which are complementary. Chamber 44 having barbs 46, screw cavity 50 and hook barbs 48 is similar to vertical mullion 26, shown in FIG. 5. An extra hook barb 320 and cavity 322 are formed at the side of the female half 86 and male half 88.

The female flange 324 of female half 86 has a rounded end with side barb 326. Side barb 326 snaps into interlocking engagement with fin 328 of male half 88. Extended male flange 330 of male half 88 includes an arrow head end 58, wrap around weather gasket 332 with fluted curved reveals 61.

In this alternative, the integrated structural thermal break 70 formed in each shell of female half 34 and male half 36 of vertical mullion 26 is replaced with premolded thermal break spacers 334. Thermal break spacers 334 preferably have an "S" shape, or a "C" shape or portions thereof, in one or multiple portions, with the segments of the spacer 334 subjected only to compression stress. Thermal break spacers 334 are positioned between the two interlocking portions of each male half 88 and female half 86.

An exterior front portion 336 of female half 86 has an inner end flange 338 extending inward and parallel to the mullion. Flange 340 extends outward from an interior rear portion 342 of female half 86. Front portion 336 and rear portion 342 are mechanically restrained with respect to each other at two connection points 344 for improving rigidity.

Exited from inner end flange 338 is a pair of channel hook shapes 346. A perpendicular web 348 connects to a tapered flange lip 350 to form the short side of the hook shape 346. Flange 340 of rear portion 342 has a pair of channel hook shapes 352 similar to and positioned opposite of hook shapes 346.

Front portion 336 and rear portion 342 of female half 86 are assembled by engaging one side of the "S" shaped premolded thermal break spacer 334 with the matching tapered flange lip 350, of rear portion 342. In a first step, spacer 334 is urged inward until it passes barb 354 and snaps in place inside and around hook shapes 352.

In a second step, front portion 336 is retracted outwardly so that channel hook shape 346 engage matching shaped cavities at the other side of "S" shaped spacers 334. After urging the front portion 336 in place, front portion 336 is locked in place by driving screws 153 into cavity 356 between channel hook shape 346 and flange 358. Screws 153 have threaded engagement at the two side walls of cavity 356, as shown in dotted line.

In the alternative, front portion 336 and rear portion 342 are interlocked by inserting a premolded thermal break wedge 360 into cavity 356. Cavity 322 is similar to cavity 356. In alternative modifications either of the cavities can receive screws, wedges or both.

An alternative to using the premolded wedge 360 is to use a cast-in-place continuous thermal break wet application. The cast-in-place wet application can be applied in either cavities 356 and 322 or both, which provides an integrated structural performance, between front portion 336 and rear portion 342.

It will be appreciated that screws 153, wedge 360 and thermal break spacer 334 can be formed in plurality of small length pieces of at least two pieces per connection point for each mullion half.

Alternative embodiments of the invention now will be described with reference to FIGS. 21–101.

Figure 21:
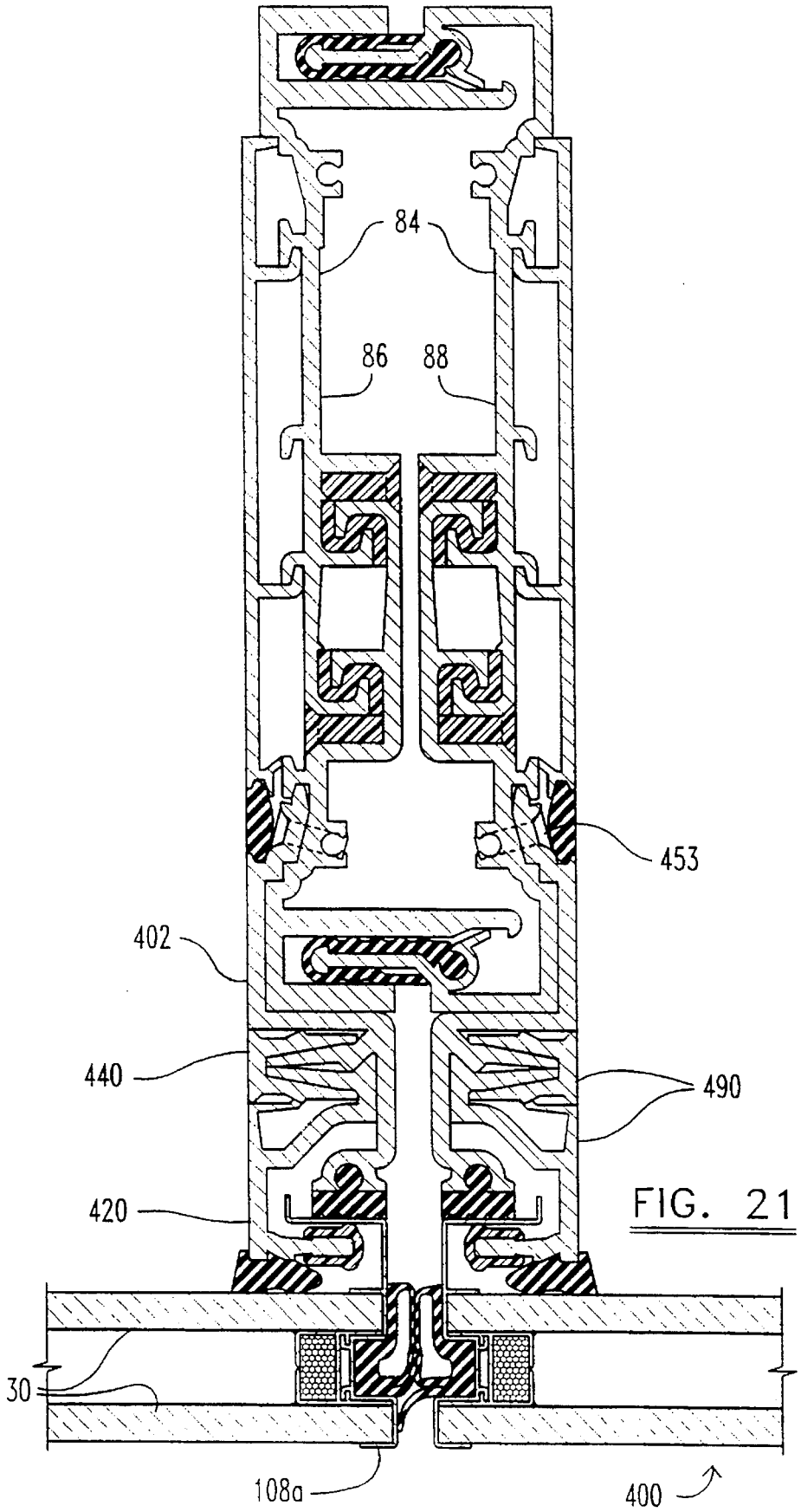
FIG. 21 is a horizontal cross-sectional view of an alternative vertical mullion.

FIG. 21 is a horizontal cross-sectional view through vertical mullion 84. Mullion 84 has interlocking male and female halves 86, 88, which preferably are interconnected as in the FIG. 20 embodiment, for example. Mullion 84 extends in a longitudinal direction toward curtainwall 400, which includes individual building panels 30. Panels 30 preferably are formed of glass, although other materials, such as metal, plastic, granite, etc., also can be used.

Mullion 84 of FIG. 21 includes mullion portions or extensions 402, which are secured to mullion halves 86, 88 preferably by screws 453 or equivalent fasteners. Alternatively, mullion extensions 402 can be integrally formed with mullion halves 86, 88, in this embodiment and in the other embodiments described herein. Holding elements 490, preferably retainer clip assemblies each including retainer 420 and channel clip 440, secure curtainwall 400 to each mullion extension 402. Channel clip 440 is a snap-locking element, as will be described with reference to FIGS. 22–23. Installation of holding element 490 causes retainer 420 to retract away from the panels of curtainwall 400 and press panel fastener **108*a* against mullion extension 402**.

Figure 22:
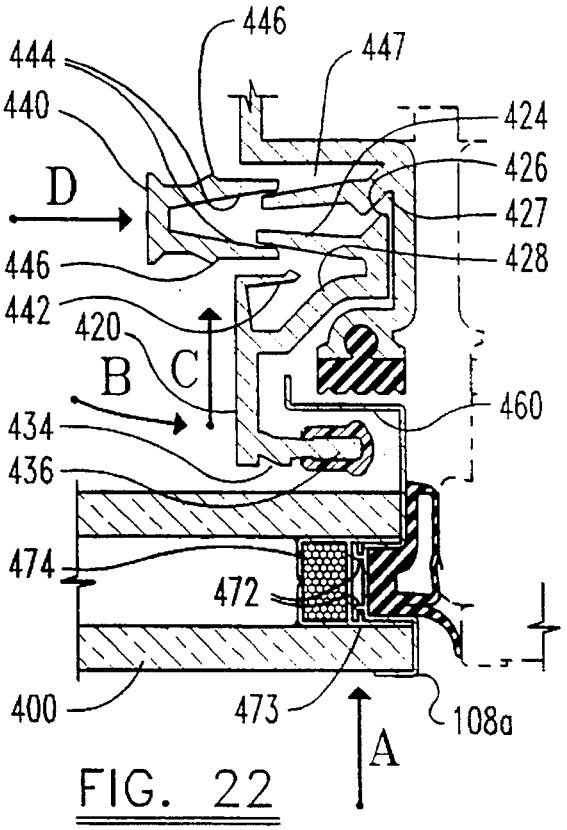
FIGS. 22–23 are horizontal cross-sectional views showing installation steps for the FIG. 21 mullion.
Figure 23:
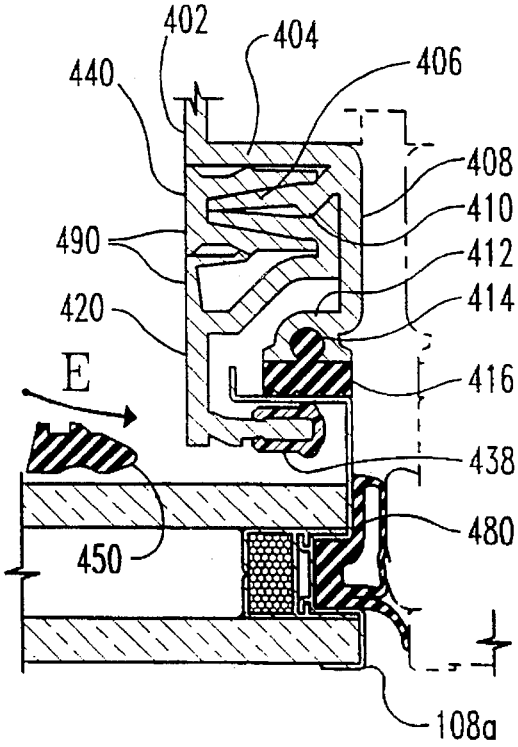

FIGS. 22–23 illustrate holding element 490 in greater detail and show a preferred manner of installing curtainwall 400 on each mullion extension 402. Curtainwall 400 is secured to panel fastener **108*a*, which preferably includes an outer metal edge in contact with panels 30. Curtainwall 400 and panel fastener 108*a* are moved horizontally in the direction of arrow A toward weather gasket 416, which is secured to frontal portion flange 412 of mullion extension 402 by engagement with cavity 414. Weather gasket 416 acts as a thermal break between mullion extension 402 and angled flange 460 of panel fastener 108*a***.

Subsequently, retainer 420 is moved in the direction of arrow B so that outer flange 436 of retainer 420, preferably surrounded by thermal insulation jacket 438, is between curtainwall 400 and angled flange 460 of panel fastener **108*a*. Jacket 438 eliminates thermal bridging between angled flange 460 and mullion extension 402. As shown in FIGS. 22–23, intermediate flange 428 and sloped flange 424 of retainer 420 are disposed between sloped flange 406 and frontal portion flange 412 of mullion extension 402**.

Channel clip 440, which functions as a snap-locking element as will be described, then is moved in the direction of arrow D into channel space 447 of mullion extension 402, engaging and sliding along sloped flange 406 of mullion extension 402 and sloped flange 424 of retainer 420. Channel clip 440 causes retainer 420 to move in the direction of arrow C, so that outer flange 436 compresses angled flange 460 of panel fastener **108*a* against frontal portion flange 412 of mullion extension 402 to secure curtainwall 400 to mullion extension 402**.

Finally, wedging member 450, preferably a wedging gasket, is inserted in the direction of arrow E between retainer 420 and one of the panels 30 of curtainwall 400. Retainer flange 436 includes angled cavity 434, which engages an extended portion of wedging member 450, as shown in FIG. 21. Wedging member 450 improves sealing, as with wedge gasket 100 of the previous embodiments.

Curtainwall 400 thus is installed on mullion extension 402 so as to form a strong seal against air, water and other elements, readily enabling the overall structure to withstand the typical air and water infiltration tests.

Channel clip 440 includes two preferably symmetrical flanges 444, each having barbs 446. As flanges 444 of channel clip 440 engage and slide along flanges 406, 424, barb 446 of lower flange 444 engages snap flange 422 of retainer 420 and is snap-locked behind snap flange 422. Only one barb is needed to snap-lock channel clip 440 into position, but channel clip 440 is constructed symmetrically to avoid mistaken reverse installation, which can have dangerous consequences.

Channel clip 440 thus functions as a snap-locking element. As retainer 420 moves in the direction of arrow C, barb 426 of retainer 420 moves into cavity 427, which is formed behind corresponding barb 410 of mullion extension 402, to lock retainer 420 to mullion extension 402.

Weather gasket 480 is secured between the individual panels 30 of curtainwall 400, in a manner similar to that described with respect to previous embodiments. According to this embodiment, however, panel fastener 108*a* preferably includes extensions 472 to better secure panel fastener 108*a* to spacer strip 474, which has corresponding extensions 473.

As with previous embodiments, installation of the curtainwall on the mullion extension can occur from within the building or other structure on which the curtainwall is mounted.

Figure 24:
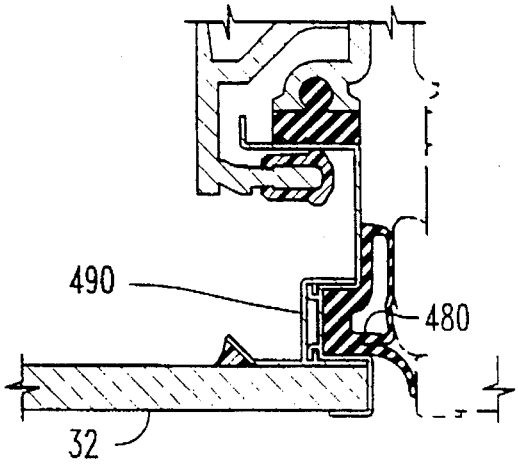
FIGS. 24–25 are horizontal cross-sectional views showing alternative edge channels.
Figure 25:
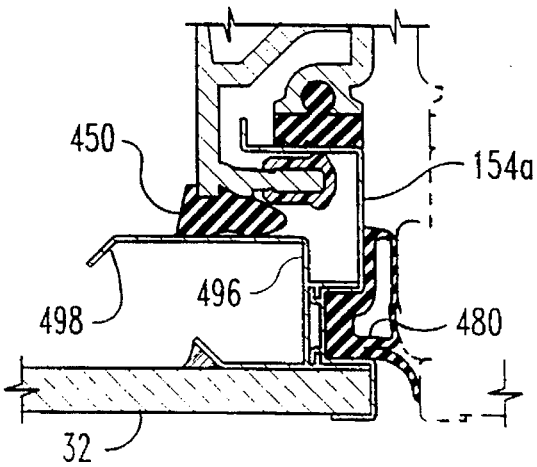

FIGS. 24–25 illustrate modified panel fasteners 490, 496 for securing a single panel 32 to mullion extension 402. According to the FIG. 24 embodiment, panel fastener 490 spaces panel 32 a desired distance away from mullion extension 402, and wedging element 450 is not used. Alternatively, according to the FIG. 25 embodiment, panel fastener 496 includes extension 498 for supporting wedging member 450.

Figure 26:
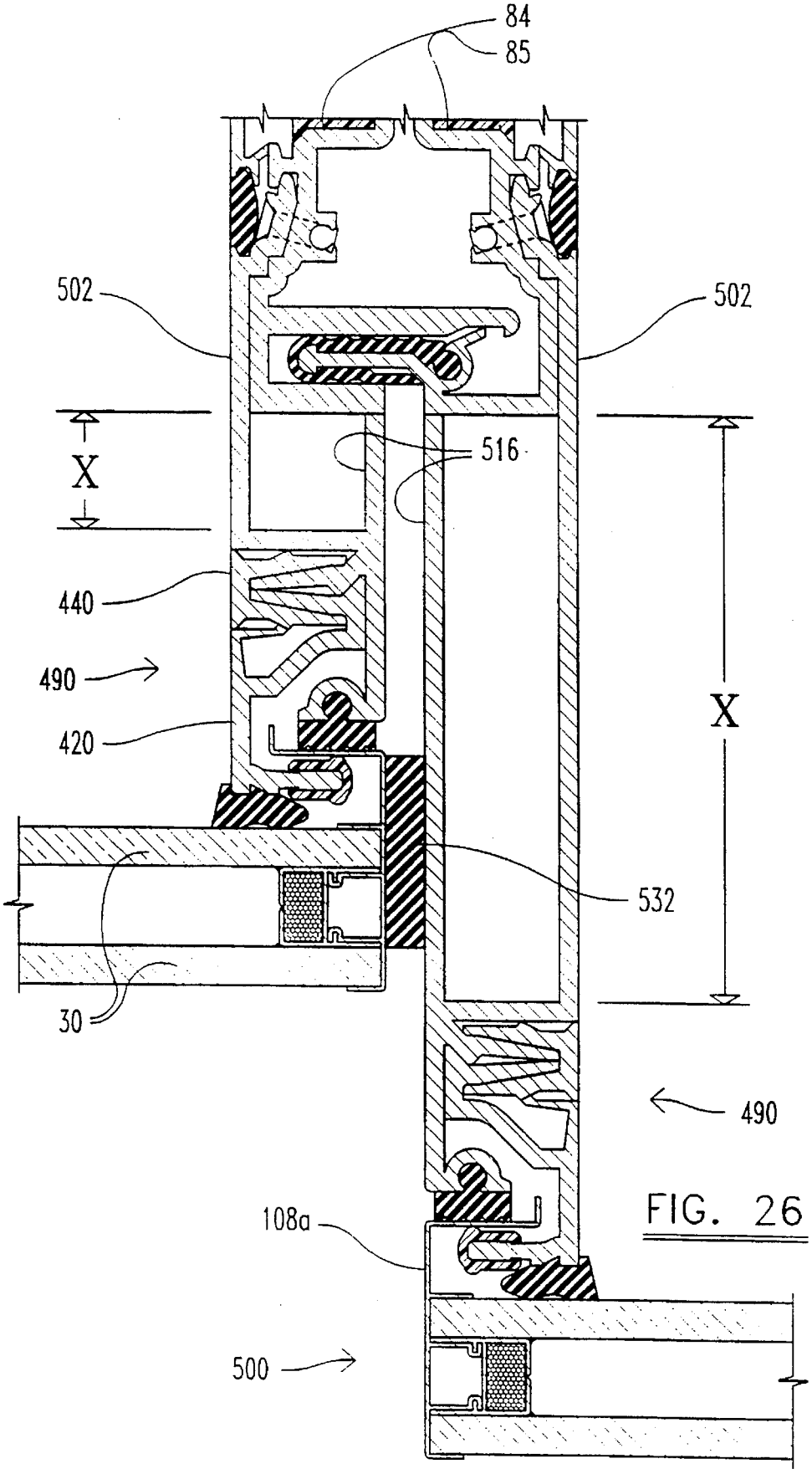
FIG. 26 is a horizontal cross-sectional view of an alternative vertical mullion.

FIG. 26 illustrates mullion extensions 502 with different extension segments 516 of length X. Compressible filler gasket 532 fills the space between adjacent mullion extension segments 516. Forming adjacent mullion extensions 502 of different lengths X causes curtainwall 500 to be of irregular three-dimensional geometry, as shown, for example, in FIG. 27. Curtainwall 500 preferably has uniformly sized glass panels 30 in six different face planes 520–525, but of course any number of face planes can be used, depending on the number of different extension lengths X that are employed. Face planes 520–525 preferably are spaced apart in approximately 0.75 inch increments, but any desired spacing can be used. If a uniform curtainwall is desired, extension lengths X can all be identical. Further, curtainwall 500 can include panels 30 of different sizes and materials, although generally it is more economical to use panels of uniform material and size.

Because face planes 520–525 preferably are at different depths, panels 30 include exposed side walls 536. The reflective faces of glass panels 30 thus create mirror images 538 of side walls 536, doubling the apparent size of side walls 536 and creating a varied geometrical appearance. Further, the irregular surface of curtainwall 500 is enhanced by daylight shading variations 540 and sun-cast shadows 542.

Figure 27:
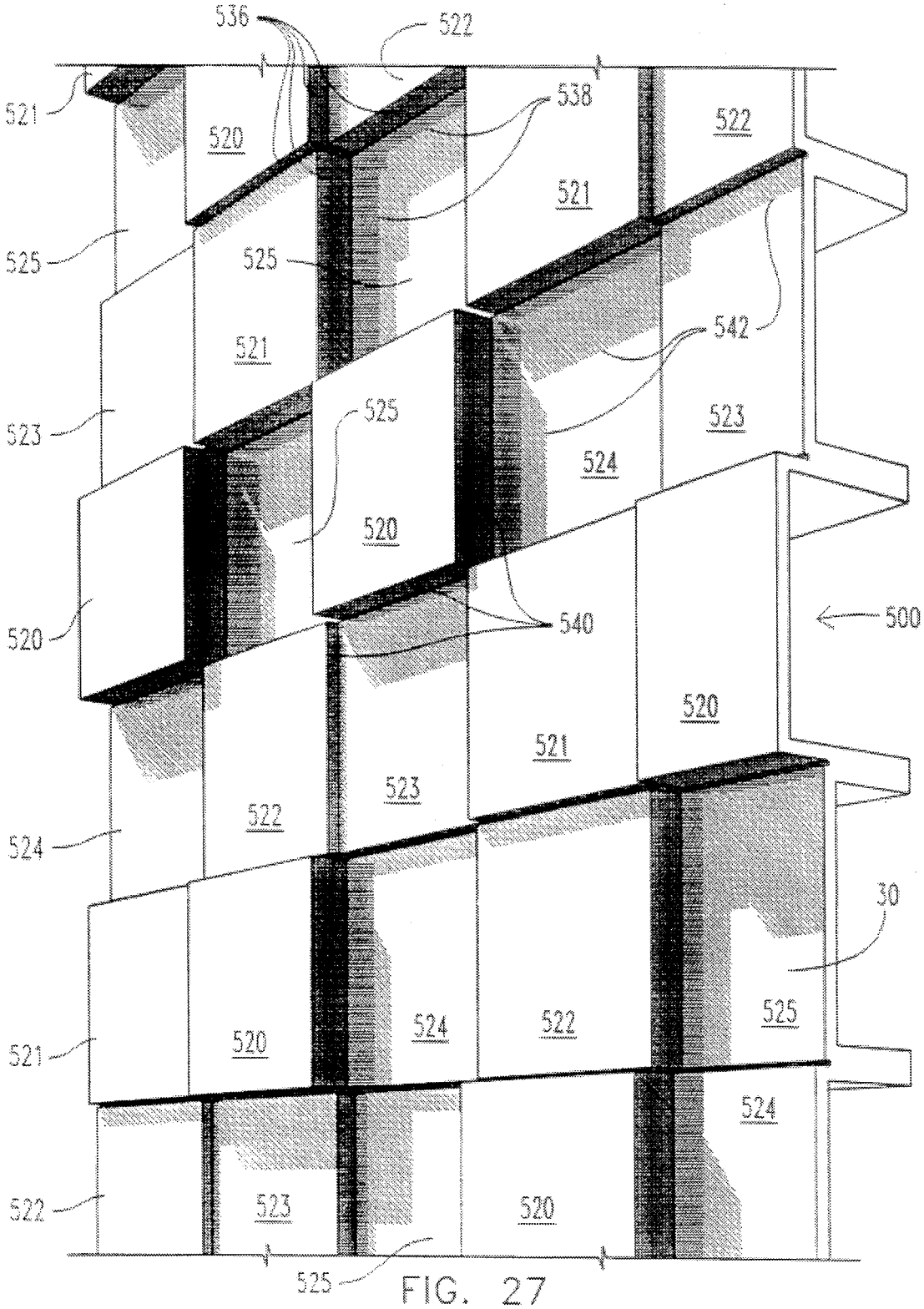
FIG. 27 is a perspective view of a curtainwall system having three-dimensional irregular geometry.

FIGS. 26–27 illustrate variable-length mullion extensions in combination with retainer clip assembly 490, which includes channel clip 440 and retainer 420. Variable-length mullion extensions also can be used with any of the previously described clip assemblies, as well as with any of the clip assemblies to be described subsequently.

Figures 28, 29, 30:
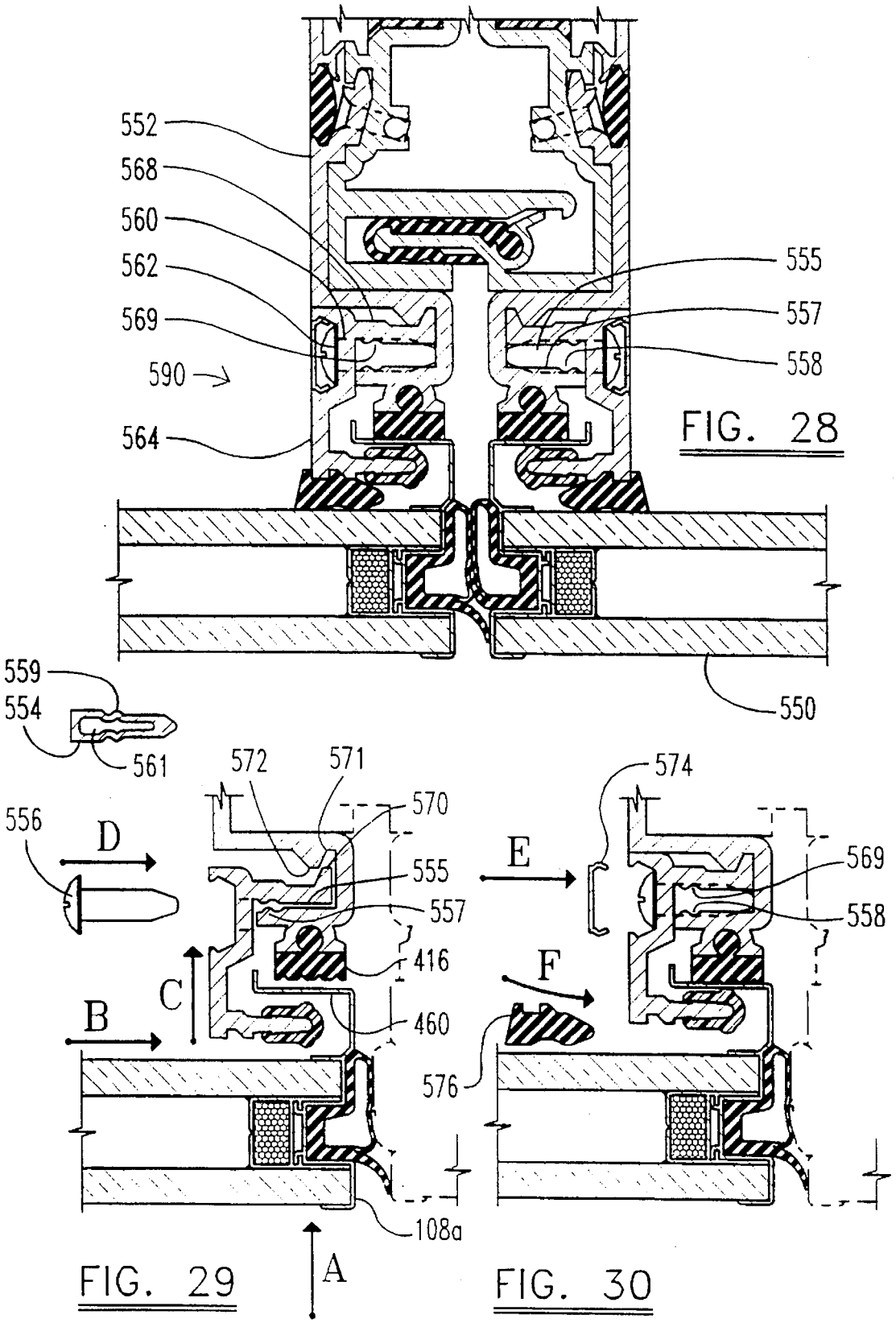
FIG. 28 is a horizontal cross-sectional view of an alternative vertical mullion.
FIGS. 29–30 are horizontal cross-sectional views showing installation steps for the FIG. 28 mullion.

FIGS. 28–30 illustrate a panel-securing system according to an alternative embodiment of the invention. A modified holding element 590, including modified retainer 564 and fastening member 556 or 55A, secures curtainwall 550 to mullion extension 552. Installation of holding element 590 causes retainer 564 to retract away from the panels of curtainwall 550 and press panel fastener 108*a* against mullion extension 552.

Retainer 564 includes depressed web 562 having aperture 560 for accommodating a fastening element, such as snap-locking wedge 554 or screw 556. Snap-locking wedge 554 includes two side barbs 559 and a hollow interior cavity 561 that allows deformation of wedge 554 to facilitate snapping action. Barbs 559 are designed to engage cavity 569 of retainer 564 and opposite cavity 558 in flange 557 of mullion extension 552.

To secure curtainwall 550 on mullion extension 552, curtainwall 550 and its attached panel fastener 108*a* are moved in the direction of arrow A toward gasket 416, secured to mullion extension 552. Subsequently, retainer 564 is moved in the direction of arrow B to surround angled flange 460 of panel fastener 108*a* and flange 557 of mullion extension 552. Inserting wedge 554 or screw 556 through aperture 560 in retainer 564 causes retainer 564 to move in the direction of arrow C, compressing angled flange 460 against gasket 416 and securing curtainwall 550 to mullion extension 552.

Specifically, as the fastening element enters space 555 between flange 568 of retainer 564 and flange 557 of mullion extension 552, barb 570 at the end of flange 568 enters cavity 571 behind barb 572 of mullion extension 552. Simultaneously, angled flange 460 of panel fastener 108*a* is sandwiched between retainer 564 and gasket 416. Snap-locking wedge 554 is inserted into channel 555 so that barbs 559 at the sides of wedge 554 snap-lock into cavities 558, 569. Cap 574 then is applied over the fastening element in the direction of arrow E, and wedging gasket 576 is inserted in the direction of arrow F between retainer 564 and curtainwall 550, thereby securing curtainwall 550 to mullion extension 552.

Preferably, at least two fastening elements are used per retainer 564 to secure curtainwall 550 to mullion extension 552. A single fastening element also can be used, however. The fastening elements, that is, snap-locking wedge 554 and screw 556 or their equivalents, preferably are formed of plastic or metal.

Figure 31:
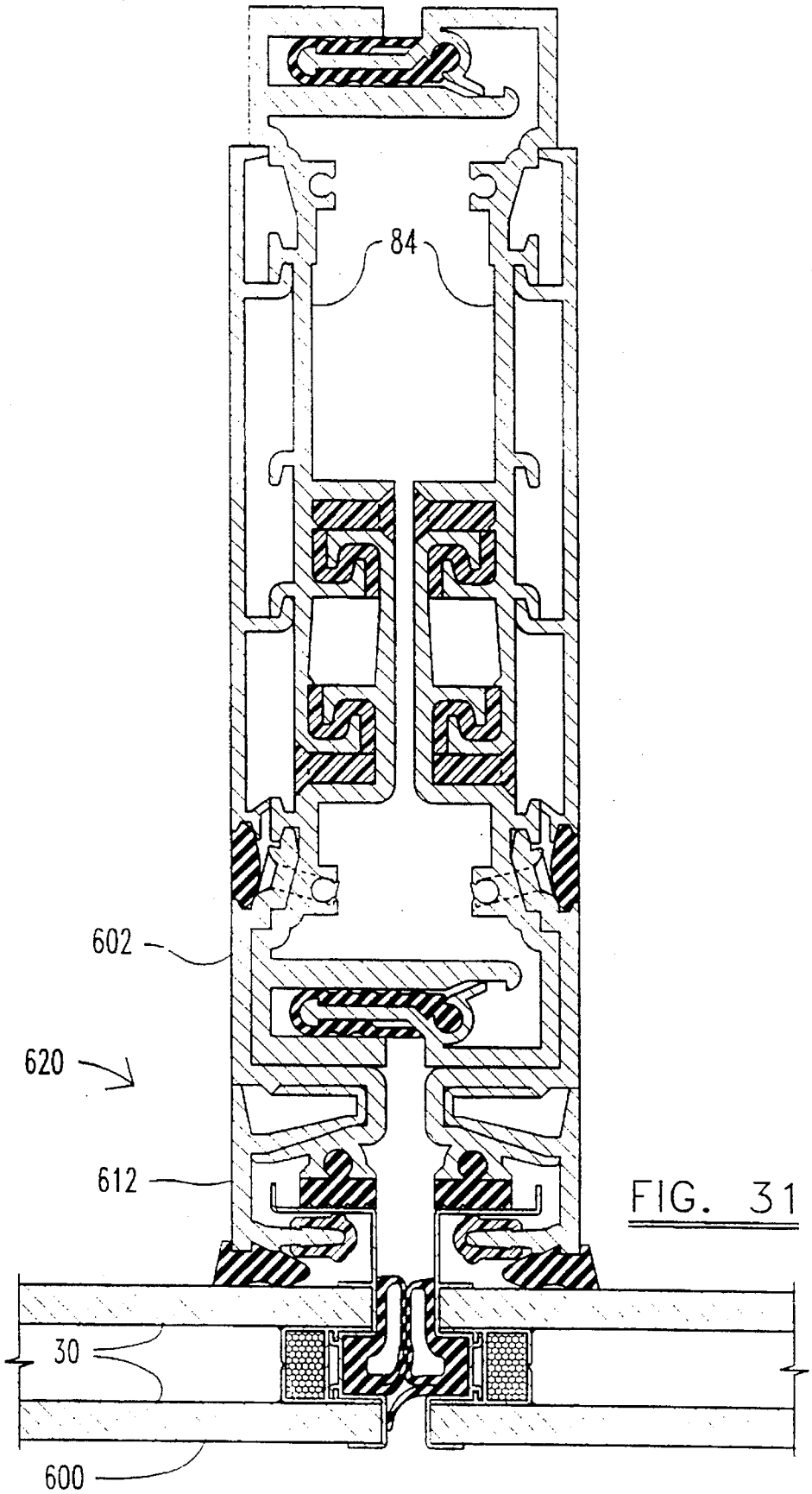
FIG. 31 is a horizontal cross-sectional view of an alternative vertical mullion.
Figure 32:
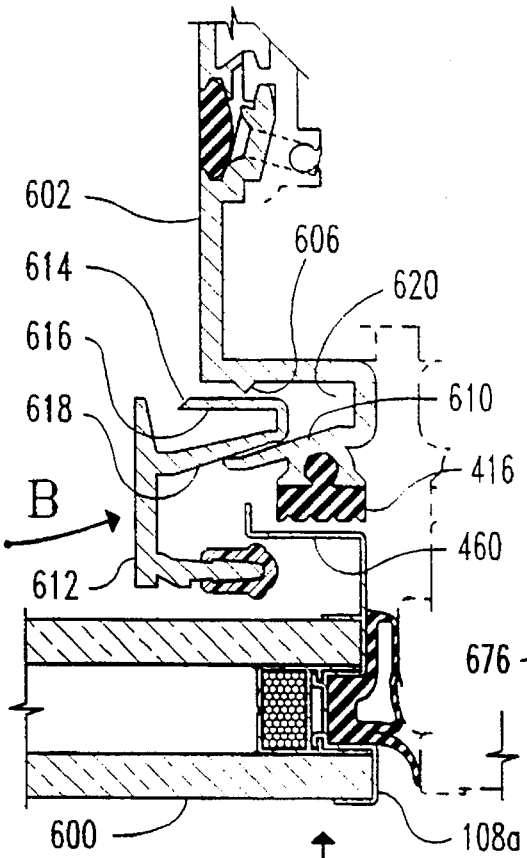
FIGS. 32–33 are horizontal cross-sectional views showing installation steps for the FIG. 31 mullion.
Figure 33:
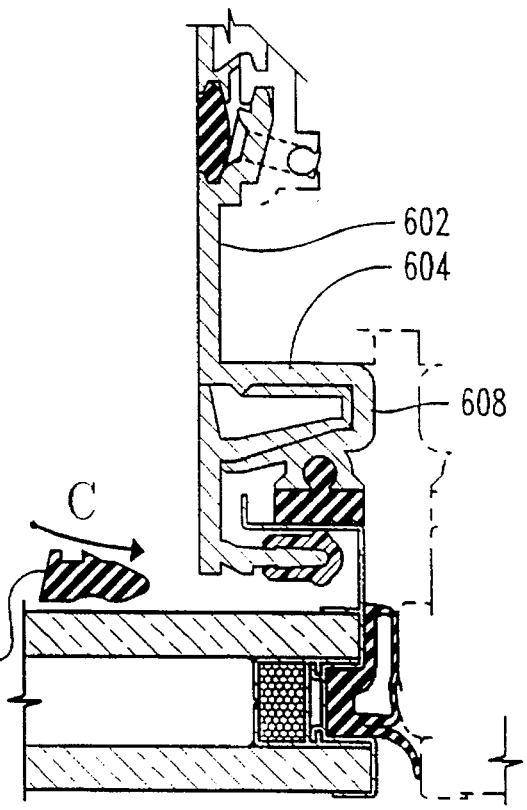

FIGS. 31–33 show another embodiment according to the invention. A modified holding element 620, including modified retainer 612, secures curtainwall 600 to mullion extension 602. Retainer 612 includes flanges 616, 618 for snap-locking into channel 620 of mullion extension 602. Retainer 612 thus is a snap-locking element and, when installed, retracts away from the panels of curtainwall 600 and presses panel fastener 108*a* against mullion extension 602, as will be described.

After curtainwall 600 and attached panel fastener 108*a* are moved in the direction of arrow A toward gasket 416, retainer 612 is moved in the direction of arrow B so that tip 614 of flange 616 engages and snap-locks behind barb 606, which is disposed within channel 620 of mullion extension 602. Angled flange 618 of retainer 612 slides along frontal portion flange 610 of mullion extension 602 to guide flange 616 into the snap-locked position. Retainer 612 thus is a snap-locking element that is snap-locked within channel 620 of mullion extension 602. As with previous embodiments, wedging gasket 676 then is inserted in the direction of arrow C between curtainwall 600 and retainer 612.

Figure 34:
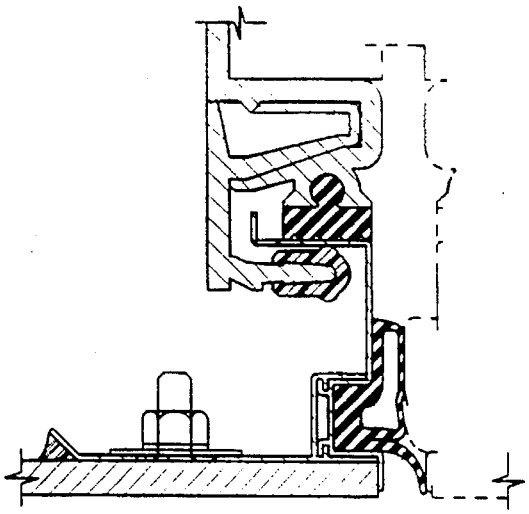
FIGS. 34–35 are horizontal cross-sectional views showing back-attached and edge-attached facing panels, respectively.
Figure 35:
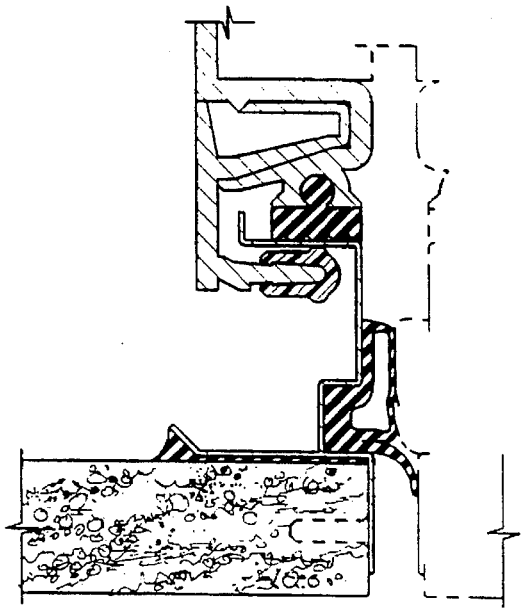

FIGS. 34–35 are similar to FIGS. 12–13 and illustrate, respectively, embodiments of back-attached facing panels and edge-attached facing panels, which can be used with any of the panel-securing systems disclosed herein.

Figure 36:
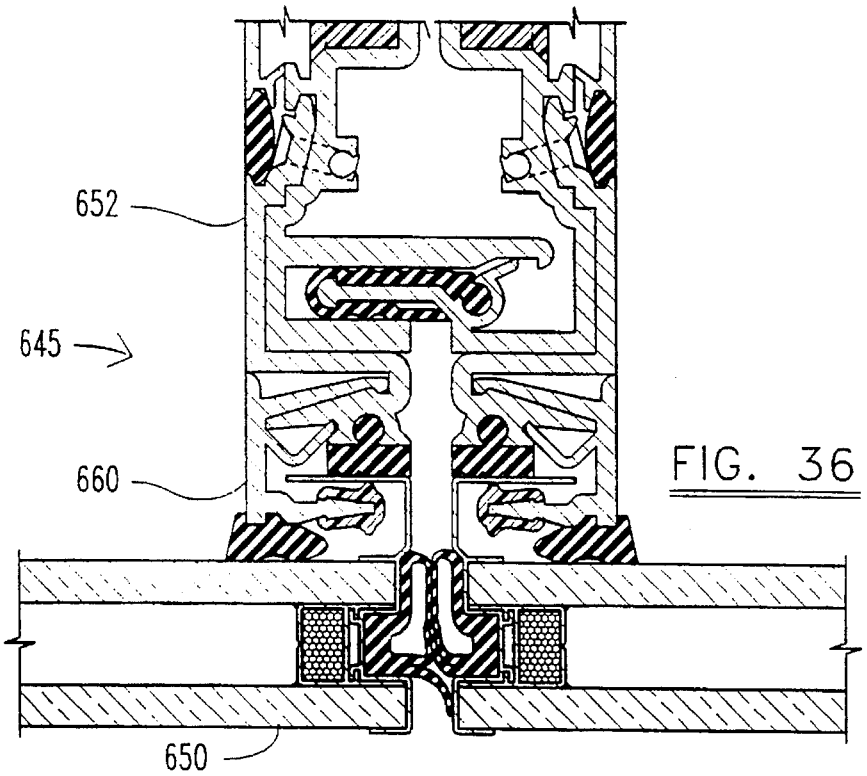
FIG. 36 is a horizontal cross-sectional view of an alternative mullion.
Figure 37:
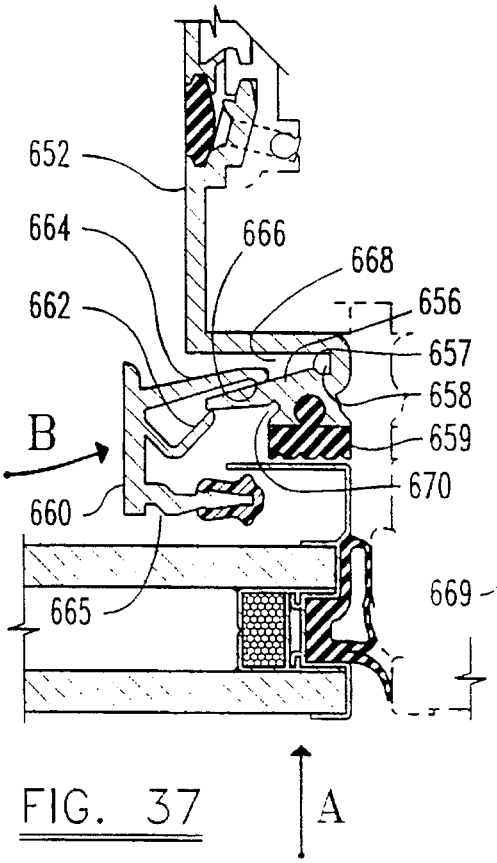
FIGS. 37–38 are horizontal cross-sectional views showing installation steps for the FIG. 36 mullion.
Figure 38:
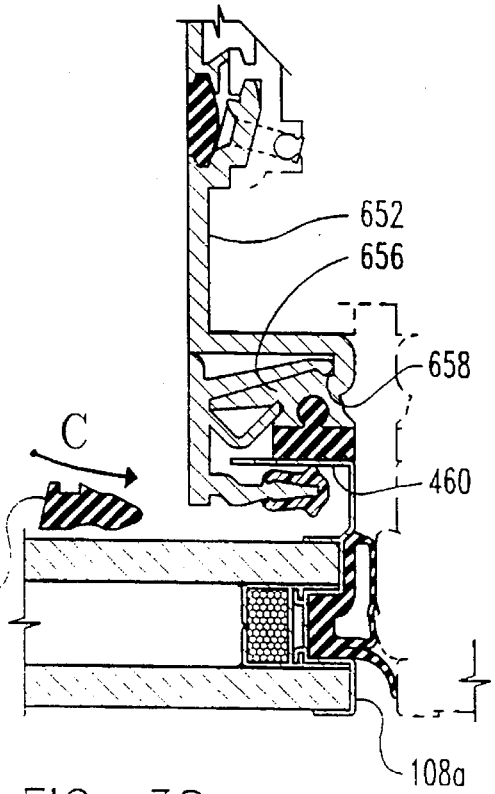

FIGS. 36–38 illustrate a further panel-securing embodiment according to the invention. A modified holding element 645, including modified retainer 660, secures curtainwall 650 to mullion extension 652. Retainer 660 includes angled flange 662 and inner flange 664 for engaging and snap-locking behind flange 656 of mullion extension 652. Retainer 660 thus is a snap-locking element and, when installed, retracts away from the panels of curtainwall 650 and presses panel fastener 108*a* against mullion extension 652, as will be described.

As with previous embodiments, the panels of curtainwall 650 and panel fastener 108*a* are moved in the direction of arrow A so that angled flange 460 of panel fastener 108*a* moves toward gasket 659. Retainer 660 then is moved in the direction of arrow B, so that inner flange 664 enters channel cavity 668 of mullion extension 652 and so that inner flange 664 and angled flange 662 engage and slide along opposite sides of flange 656 of mullion extension 652. Angled flange 460 of panel fastener 108*a* thus is compressed between flange 665 of retainer 660 and gasket 659. End barb 666 of retainer 660 snap-locks into cavity 658 behind barb 657, and the end of angled flange 662 snap-locks into cavity 670; retainer 660 thus is a snap-locking element. Finally, wedge gasket 669 is moved in the direction of arrow C between retainer 660 and curtainwall 650.

Figure 39:
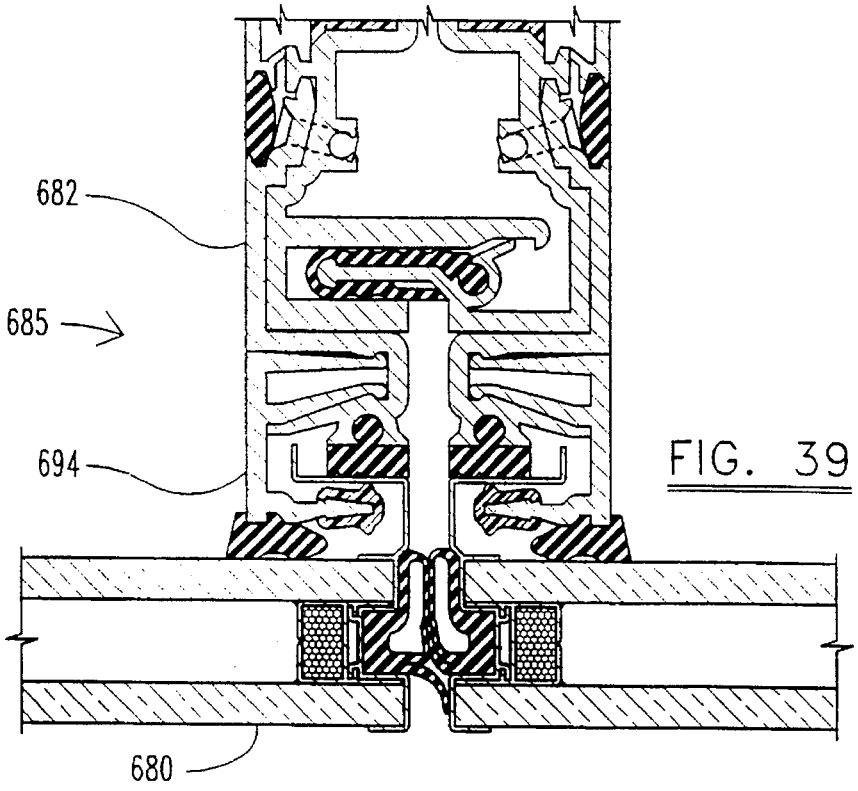
FIG. 39 is a horizontal cross-sectional view of an alternative vertical mullion.
Figure 40:
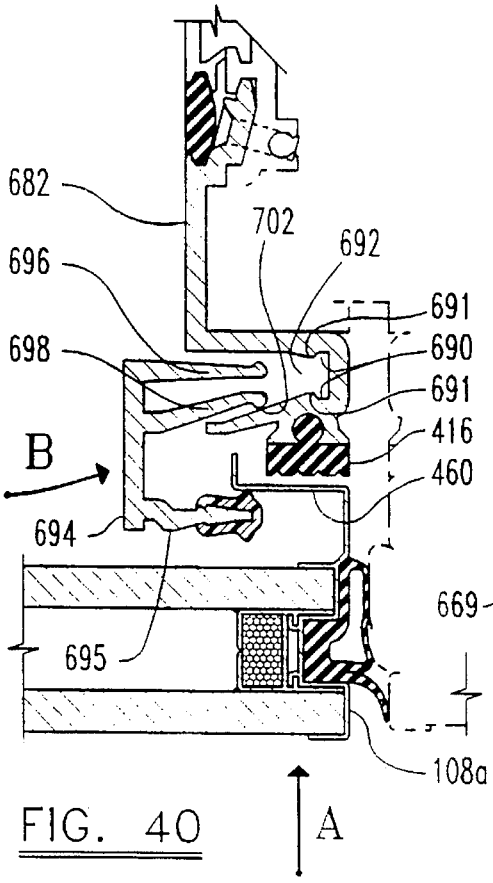
FIGS. 40–41 are horizontal cross-sectional views showing installation steps for the FIG. 39 mullion.
Figure 41:
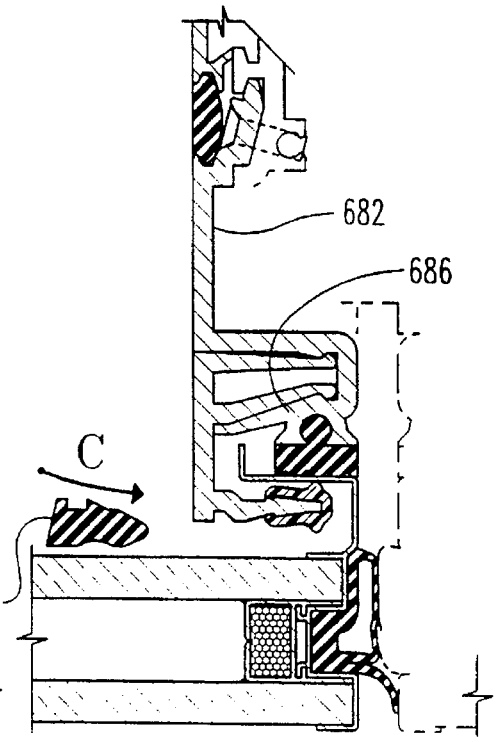

FIGS. 39–41 illustrate another embodiment according to the invention. A modified holding element 685, including modified retainer 694, secures curtainwall 680 to mullion extension 682. Retainer 694 includes twin flanges 696, 698 that are inserted and snap-locked into cavity 692 of mullion extension 682. Retainer 694 thus is a snap-locking element and, when installed, retracts away from the panels of curtainwall 680 and presses panel fastener 108*a* against mullion extension 682, as described below.

As with previous embodiments, curtainwall 680 and angled flange 460 of panel fastener 108*a* are moved in the direction of arrow A toward gasket 416. Then, retainer 694 is moved in the direction of arrow B so that twin flanges 696, 698 enter and are guided along channel space 692 of mullion extension 682. Flange 695 of retainer 694 applies compressive force to angled flange 460 of panel fastener 108*a*. End barbs 702 of flanges 696, 698 then snap-lock into twin cavities 690 behind twin barbs 691 in mullion extension 682, securing retainer 694 and securing curtainwall 650 on mullion extension 682. Finally, wedge gasket 669 is moved in the direction of arrow C between flange 695 and curtainwall 680.

In the embodiments of FIGS. 21–41, the illustrated mullion extensions extend in a longitudinal direction toward their respective panels. The channels formed in the mullion extensions or holding elements or retainers, on the other hand, are angled with respect to the longitudinal direction. Inserting the holding elements or snap-locking elements or retainers of these embodiments into their respective mullion channels causes them to move inwardly away from the panels to urge and press the panel fasteners toward the mullion extensions, to secure the panels to the mullion extensions.

Figure 42:
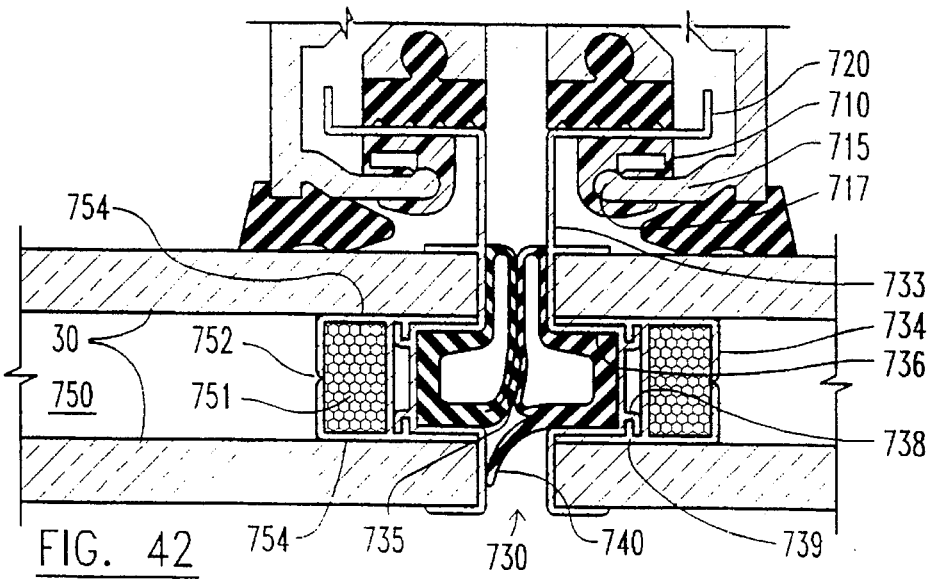
FIGS. 42–44 are horizontal cross-sectional views of face panel holding elements.
Figure 43:
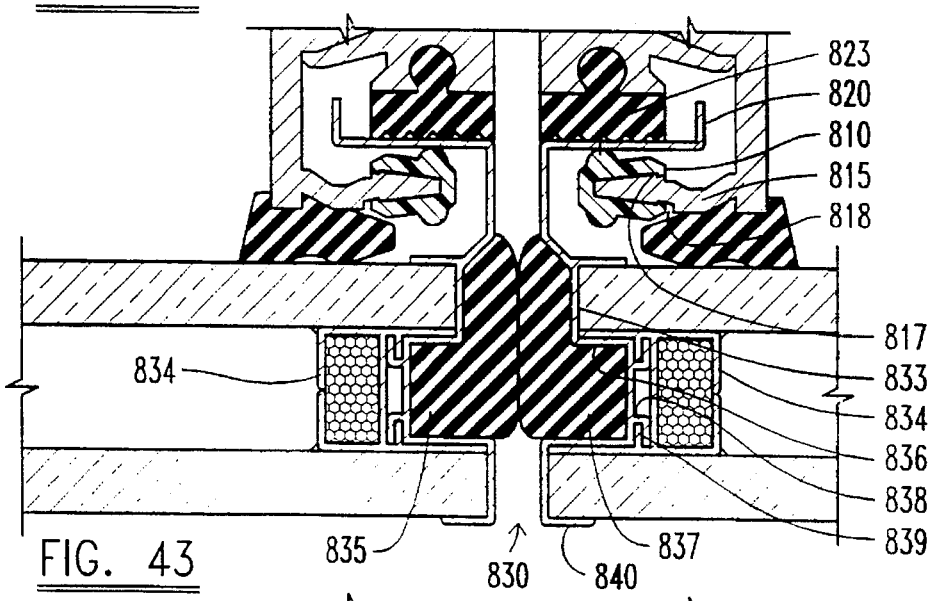
Figure 44:
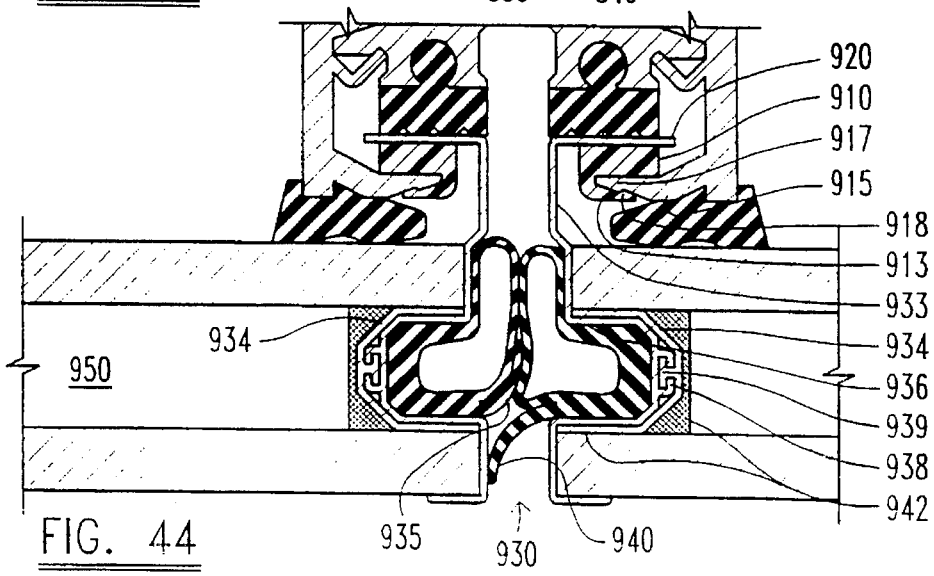

FIGS. 42–44 show preferred thermal insulation jacket, weather gasket, panel-attached panel fastener and retainer flange embodiments usable with any of the previously described holding element embodiments.

According to the FIG. 42 embodiment, thermal insulation jacket 710 continuously or in small-length pieces (with a minimum of one) engages angled flange 720 of panel fastener 733 and wraps around retainer flange 715, which includes end bulb 717. Weather gasket 730 includes angled lip 735, which extends toward an adjacent panel to provide additional compressive supporting force within gasket 730, thus better holding gasket 730 in place and providing enhanced sealing. Angled lip 735 preferably is the same as angled lip 740, but one panel is installed before the other panel, causing the lips of the gasket to be squeezed and folded as shown.

FIG. 42 shows insulated glass panel 30 with two preferably glass sheets having cavity 750 thereinbetween to improve thermal insulation and achieve energy savings. Inside cavity 751 of desiccant strip 734 is connected with cavity 750 between the sheets, through narrow slot 752 or a similar opening.

Cavity 751 of desiccant strip 734 has a desiccator substance to absorb moisture from cavity 750 between the sheets, to eliminate the possibility of moisture condensation on the inner surfaces of the glass sheets and to avoid obstruction of clear vision through the sheets or panels.

Desiccant strip 734 is laminated to the sheets with primary seal adhesive 754, which holds the sheets together while spacing them apart, providing a weather seal and securing the panel fastener 733 at the edge of the panel.

Conventional desiccant spacer strips are simple, made of thin gauge, and may have bends and holes that can be deformed to follow thermal expansion of the panels. 0n the other hand, desiccant strip 734 holds and anchors panel fastener 733; therefore, it may be formed of a heavier gauge.

Differential thermal expansion between the sheets and heavier metal desiccant strip 734 is provided to avoid resultant stresses that may cause delamination of the primary seal adhesive, or metal fatigue and structural failure of the panel fastener.

Preferably, desiccant strip 734 should be a multiplicity of small-length pieces, or formed of folded, perforated, sliced, expanded, corrugated (into ridges or folds) or wrinkled sheet metal, so that expected deformity in length is distributed and dissipated into the numerous bends and longer lengths of metal. As an entire strip, it can still deform to follow movement of the glass.

Panel fastener 733 is secured to desiccant strip 734, and preferably includes extensions 739 to engage corresponding extensions 738 of desiccant strip 734. Panel fastener 733 preferably is not adhered but is mechanically integrated and well restrained to the insulated glass panel, and it is free and safe to expand and move longitudinally.

According to the FIG. 43 embodiment, jacket 810 is symmetrically wrapped around retainer flange 815, which includes symmetrical tip 817 and cavity 818 for engaging and holding jacket 810. Jacket 810 includes bulb 823, which is pressed against angled flange 820 of panel fastener 833. Weather gasket 830 is formed of two identical gasket portions 835, 837, each of which engages a correspondingly shaped section 836 of panel fastener 833. Gasket portions 835, 837 provide additional compressive force within gasket 830, thereby providing enhanced sealing properties.

According to the FIG. 44 embodiment, jacket 910 is substantially rectangular and engages angled flange 920 of panel fastener 933. Lip 913 of jacket 910 wraps around retainer flange 915, which includes shaped tip 917 and cavity 918 for holding jacket 910. Weather gasket 930 has angled lips 935 and is similar to gasket 730 of FIG. 42.

Additionally, section 936 of panel fastener 933 includes slotted bracket 938 for engaging and locking a corresponding T-shaped locking element 939, which is connected to spacer element 934. Gasket 930 and panel fastener section 936 provide enhanced sealing for the curtainwall panels.

Spacer strip 934 preferably is adhered to the glass sheets by using a different kind of primary seal adhesive 942, with enhanced desiccator properties. Beads of desiccator adhesive 942 are formed in the inner cavity 950.

Figure 45:
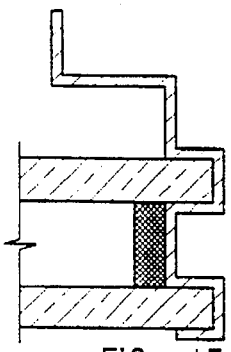
FIGS. 45–101 are horizontal cross-sectional views showing alternative face panel holding elements according to embodiments of the invention.
Figure 46:
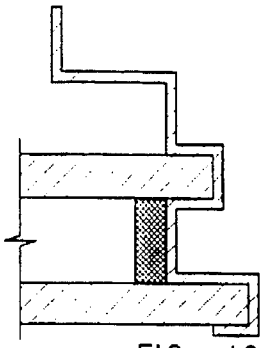
Figure 47:
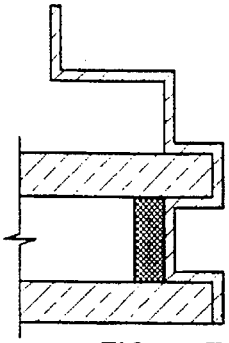
Figure 48:
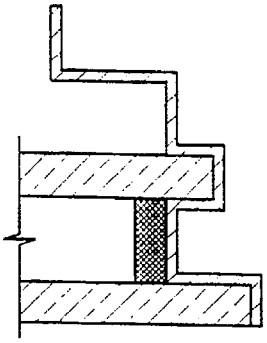
Figure 49:
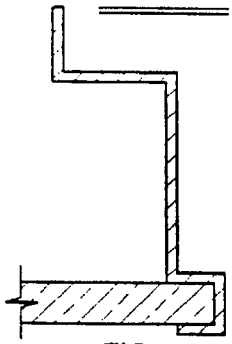
Figure 50:
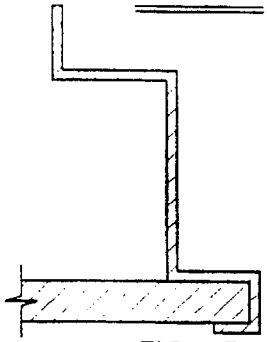
Figure 51:
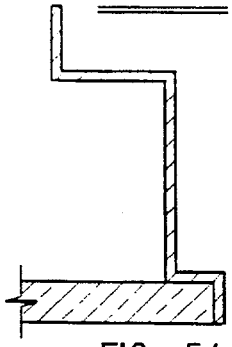
Figure 52:
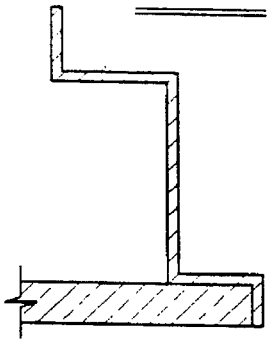
Figure 53:
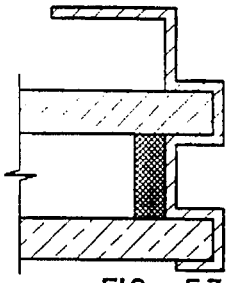
Figure 54:
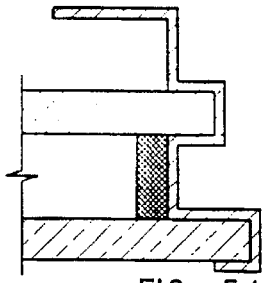
Figure 55:
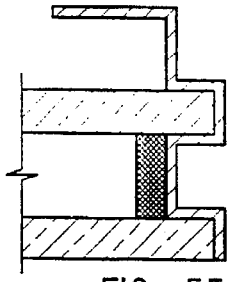
Figure 56:
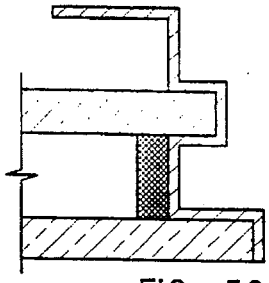
Figure 57:
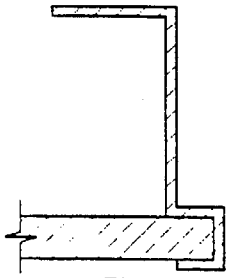
Figure 58:
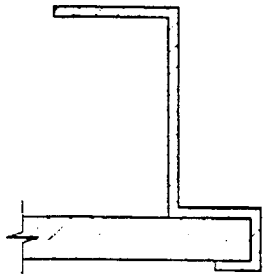
Figure 59:
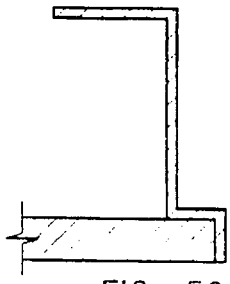
Figure 60:
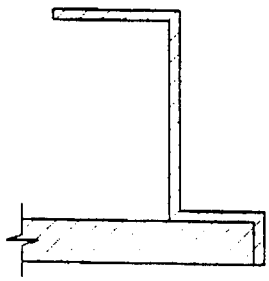
Figure 61:
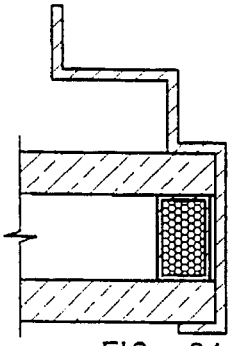
Figure 62:
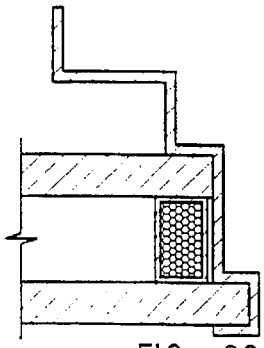
Figure 63:
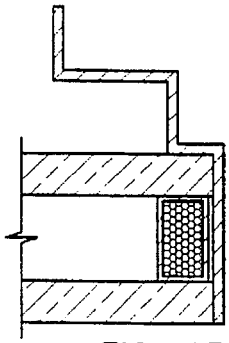
Figure 64:
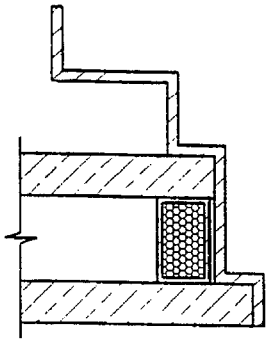
Figure 65:
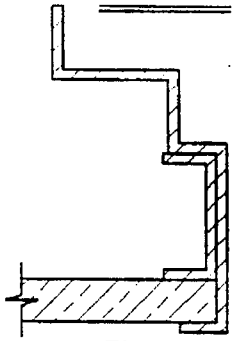
Figure 66:
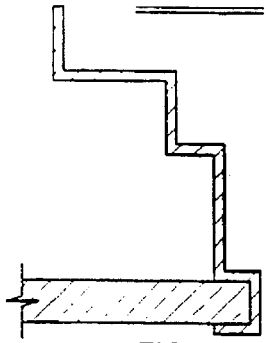
Figure 67:
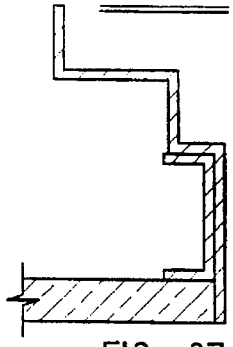
Figure 68:
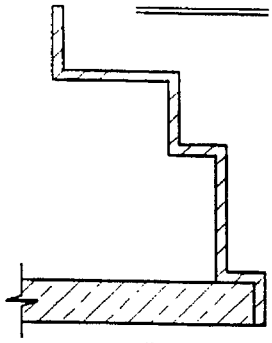
Figure 69:
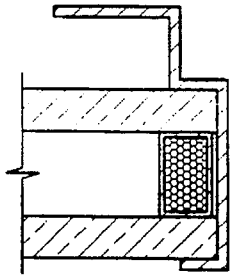
Figure 70:
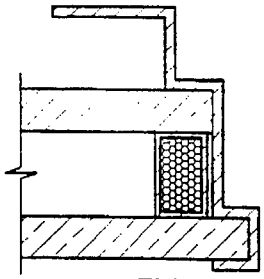
Figure 71:
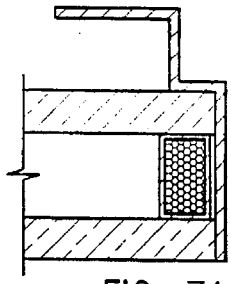
Figure 72:
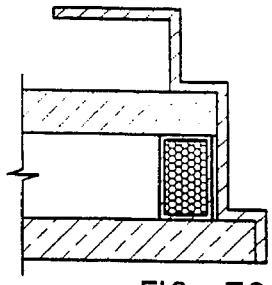
Figure 73:
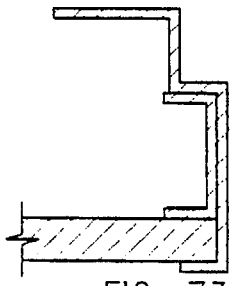
Figure 74:
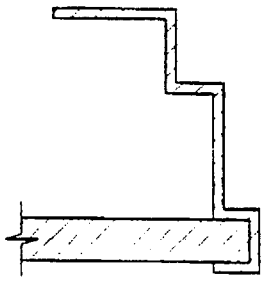
Figure 75:
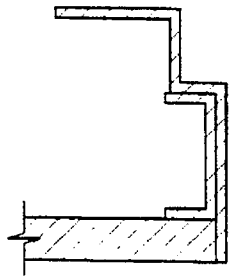
Figure 76:
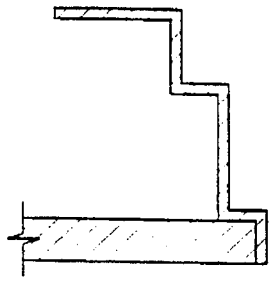
Figure 77:
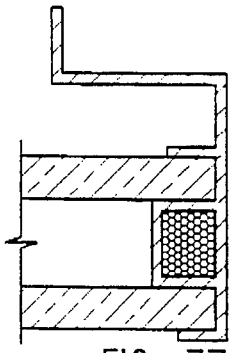
Figure 78:
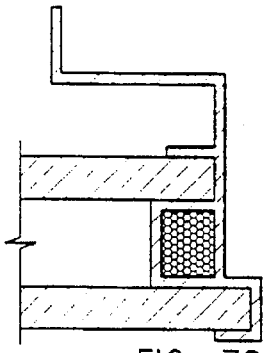
Figure 79:
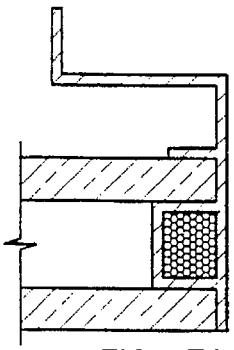
Figure 80:
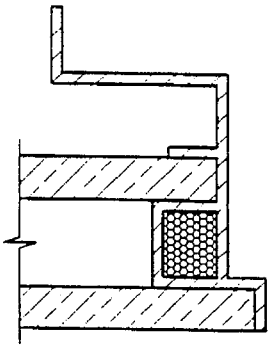
Figure 81:
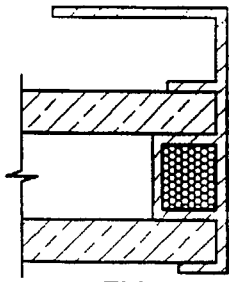
Figure 82:
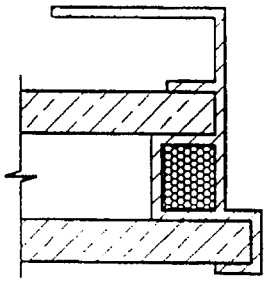
Figure 83:
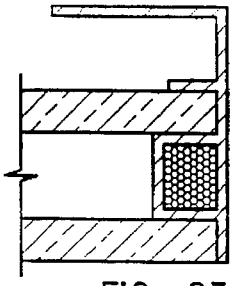
Figure 84:
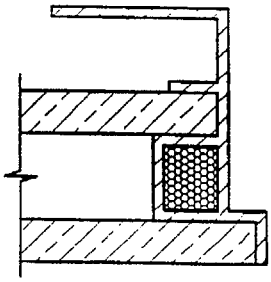
Figure 85:
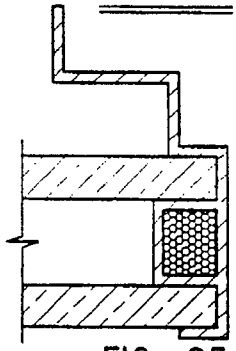
Figure 86:
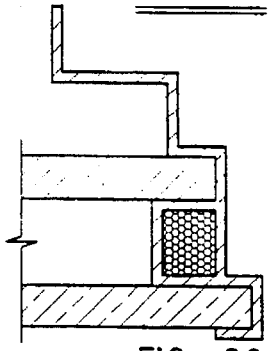
Figure 87:
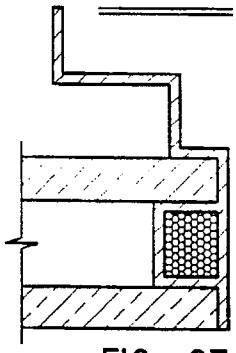
Figure 88:
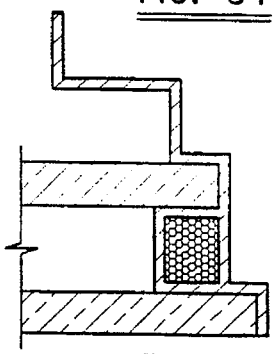
Figure 89:
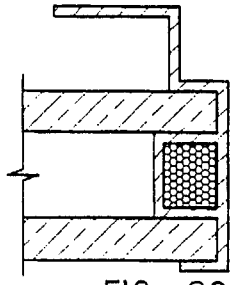
Figure 90:
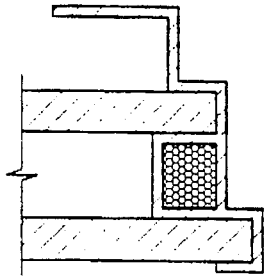
Figure 91:
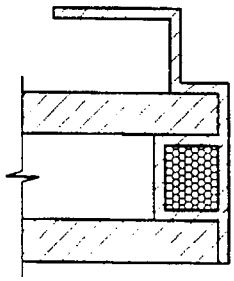
Figure 92:
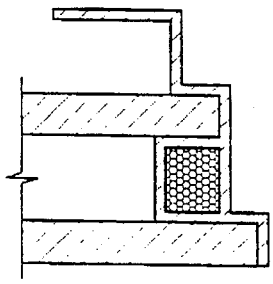
Figure 93:
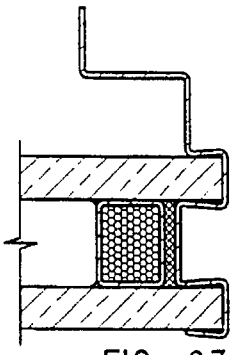
Figure 93A:
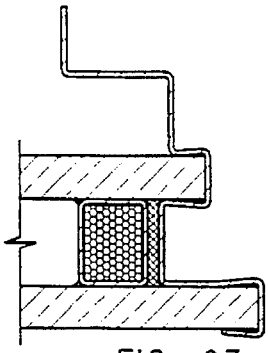
Figure 94:
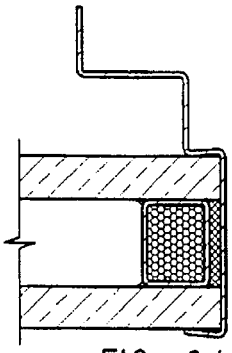
Figure 94A:
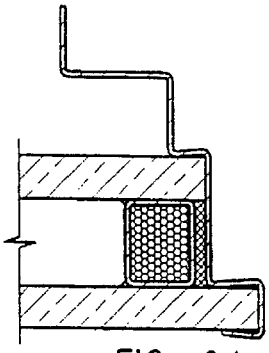
Figure 95:
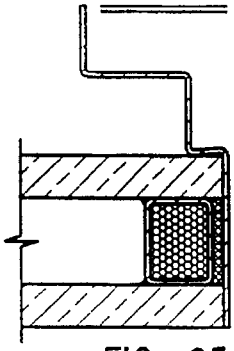
Figure 95A:
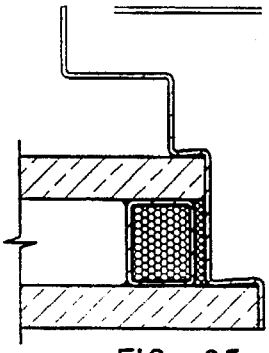
Figure 96:
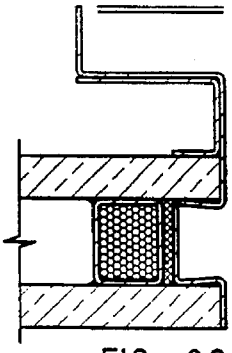
Figure 96A:
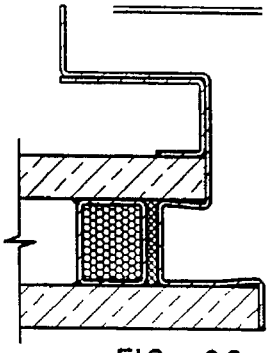
Figure 97:
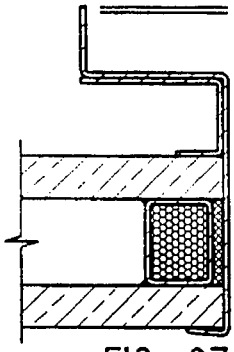
Figure 97A:
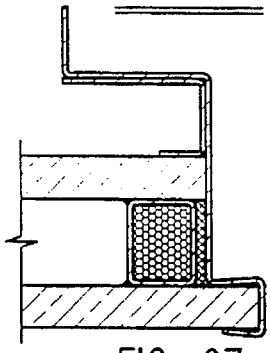
Figure 98:
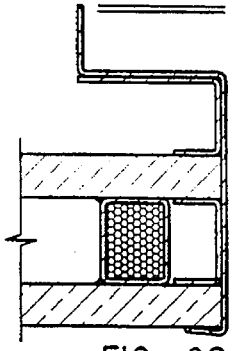
Figure 98A:
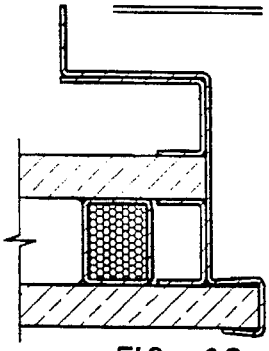
Figure 99:
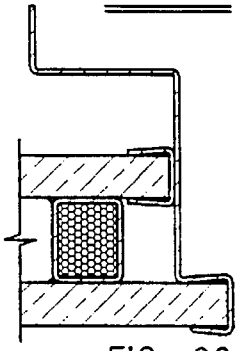
Figure 100:
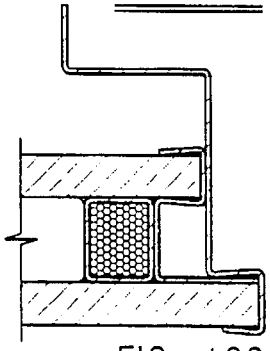
Figure 100A:
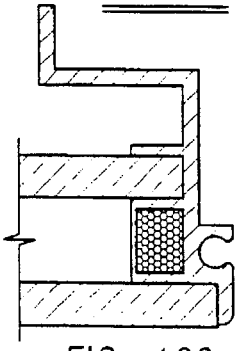
Figure 101:
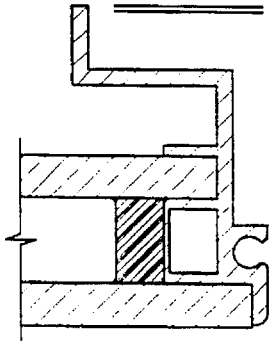

Finally, FIGS. 45–101 illustrate a variety of single-paned and double-paned curtainwalls in combination with corresponding supporting panel fasteners. A variety of embodiments of spacer elements also are illustrated between the double-paned curtainwalls. The structure and function of the illustrated curtainwalls and panel fasteners are believed to be self-evident from the Figures. Of course, the curtainwalls and panel fasteners illustrated in FIGS. 45–101 can be used with any of the previously described embodiments.

While the invention has been described with reference to preferred embodiments, this description is not intended to be limiting. It will be appreciated by those of ordinary skill in the art that modifications may be made without departing from the spirit and scope of the invention.

What is claimed is:

1. A panel-securing system for securing a panel in a desired position to a mullion located behind the panel, the panel-securing system comprising:

a panel;

a panel fastener attached to the panel and extending behind the panel;

a mullion portion having a channel formed therein, the channel being located behind the panel; and a separate holding element positioned behind the panel and received within the channel of the mullion portion and coupled to the panel fastener attached to the panel, the holding element securing the panel to the mullion portion by clamping the panel fastener to the mullion portion behind the panel, the holding element comprising a retainer coupled to the mullion portion, with the panel fastener clamped between the retainer and the mullion portion, and a snap-locking element that locks the retainer to the mullion portion by engaging the channel, wherein the holding element is a two-piece element, with the retainer and the snap-locking element being separate elements.

2. The system of claim 1, wherein the snap-locking element comprises a clip with two flanges, one of the flanges received in the channel of the mullion portion and the other of the flanges being snap-locked into the retainer to secure the retainer to the mullion portion.

3. The system of claim 1, further comprising a wedging member disposed within the channel of the mullion portion to urge the retainer away from the panel and to cause the retainer to press the panel fastener against the mullion portion.

4. The system of claim 1, wherein the mullion portion comprises a first flange that defines a portion of the channel and the retainer comprises a second flange, wherein the snap-locking element urges the first and second flanges toward each other to secure the panel to the mullion portion.

5. The system of claim 1, wherein the snap-locking element urges the retainer into locked engagement with the mullion portion.

6. The system of claim 5, wherein the retainer comprises a barb and the mullion portion comprises a cavity having a shape corresponding to the shape of the barb, further wherein the snap-locking element urges the barb of the retainer into the cavity of the mullion portion to lock the retainer to the mullion portion.

7. The system of claim 1, wherein the snap-locking element is snap-locked within the channel of the mullion portion.

8. The system of claim 7, further comprising a barb disposed within the channel of the mullion portion, the snap-locking element being snap-locked within the channel behind the barb.

9. The system of claim 7, wherein the snap-locking element comprises a first flange snap-locked into the channel of the mullion portion.

10. The system of claim 9, wherein the snap-locking element further comprises a second flange and the mullion portion comprises a cavity, the second flange being snap-locked into the cavity.

11. The system of claim 10, wherein the mullion portion comprises a third flange, the third flange being disposed between the first and second flanges of the snap-locking element.

12. The system of claim 1 wherein the snap-locking element comprises first and second flanges disposed within the channel of the mullion portion.

13. The system of claim 12, wherein the mullion portion comprises twin cavities disposed within the channel, further wherein the first and second flanges are snap-locked within the twin cavities to snap-lock the snap-locking element into the channel.

14. The system of claim 1, further comprising a plurality of mullion portions for holding a plurality of panels, the mullion portions being of different lengths so that the panels lie in different planes.

15. A panel-securing system for securing a panel in a desired position to a mullion located behind the panel, the panel-securing system comprising:

a panel;

a panel fastener attached to the panel and extending behind the panel;

a mullion portion having a channel formed therein, the channel being located behind the panel; and a separate holding element positioned behind the panel and received within the channel of the mullion portion and coupled to the panel fastener attached to the panel, the holding element securing the panel to the mullion portion by clamping the panel fastener to the mullion portion behind the panel, the holding element comprising a retainer coupled to the mullion portion, with the panel fastener clamped between the retainer and the mullion portion, and a snap-locking element that locks the retainer to the mullion portion by engaging the channel, wherein the snap-locking element comprises a clip with two flanges, one of the flanges received in the channel of the mullion portion and the other of the flanges being snap-locked into the retainer to secure the retainer to the mullion portion.

16. The system of claim 15, wherein the holding element is a two-piece element, with the retainer and the snap-locking element being separate elements.

17. The system of claim 15, further comprising a wedging member disposed within the channel of the mullion portion to urge the retainer away from the panel and to cause the retainer to press the panel fastener against the mullion portion.

18. The system of claim 15, wherein the mullion portion comprises a first flange that defines a portion of the channel and the retainer comprises a second flange, wherein the snap-locking element urges the first and second flanges toward each other to secure the panel to the mullion portion.

19. The system of claim 15, wherein the snap-locking element urges the retainer into locked engagement with the mullion portion.

20. The system of claim 19, wherein the retainer comprises a barb and the mullion portion comprises a cavity having a shape corresponding to the shape of the barb, further wherein the snap-locking element urges the barb of the retainer into the cavity of the mullion portion to lock the retainer to the mullion portion.

21. The system of claim 15, further comprising a plurality of mullion portions for holding a plurality of panels, the mullion portions being of different lengths so that the panels lie in different planes.

22. A panel-securing system for securing a panel in a desired position, the panel-securing system comprising:

a panel;

a panel fastener having two ends, one end attached to the panel and the other end extending past the panel;

a mullion portion extending in a longitudinal direction toward the panel;

a channel formed in the mullion portion, the channel being inclined with respect to the longitudinal direction; and a holding element coupled to the other end of the panel fastener the holding element being inserted into the inclined channel and engaging the panel fastener to urge the panel fastener toward the mullion portion and thereby secure the panel to the mullion portion.

23. The system of claim 22, wherein the holding element comprises a retainer coupled to the panel fastener and a locking clip that connects the retainer to the inclined channel.

24. The system of claim 22, further comprising a plurality of mullion portions for holding a plurality of panels, the mullion portions comprising mullion extensions having different lengths to cause the panels to lie in different planes.

25. A panel-securing system for securing a plurality of panels such that faces of the panels are in different face planes, the panel-securing system comprising:

a plurality of panels;

a plurality of panel fasteners, each fastener attached to an edge of a panel and extending behind the panel;

a plurality of mullion extensions of different lengths, each mullion extension having a channel formed therein and being positioned behind the panel; and a plurality of holding elements, each mullion extension channel receiving one of the holding elements, the holding elements being coupled with respective panel fasteners attached to the panels to secure the panels to the mullion extensions so that the different lengths of the mullion extensions locate the faces of the panels in the different face planes.

* * * * *